US010840610B2

(12) United States Patent
Hsieh et al.

(10) Patent No.: US 10,840,610 B2
(45) Date of Patent: Nov. 17, 2020

(54) ANTENNA DEVICE

(71) Applicant: PEGATRON CORPORATION, Taipei (TW)

(72) Inventors: Chia-Hsing Hsieh, Taipei (TW); An-Shyi Liu, Taipei (TW)

(73) Assignee: PEGATRON CORPORATION, Taipei (TW)

( * ) Notice: Subject to any disclaimer, the term of this patent is extended or adjusted under 35 U.S.C. 154(b) by 36 days.

(21) Appl. No.: 16/254,762

(22) Filed: Jan. 23, 2019

(65) Prior Publication Data

US 2019/0245278 A1 Aug. 8, 2019

(30) Foreign Application Priority Data

Feb. 7, 2018 (TW) ..... 107104374 A

(51) Int. Cl.

| | |
|---|---|
| ***H01Q 25/04*** | (2006.01) |
| ***H01Q 3/24*** | (2006.01) |
| ***H01Q 1/52*** | (2006.01) |
| *H01Q 5/321* | (2015.01) |

(52) U.S. Cl.

CPC ..... *H01Q 25/04* (2013.01); *H01Q 1/521* (2013.01); *H01Q 3/247* (2013.01); *H01Q 5/321* (2015.01)

(58) Field of Classification Search

CPC ..... H01Q 25/04; H01Q 3/247; H01Q 1/521; H01Q 5/321; H01Q 9/285; H01Q 15/14; H01Q 21/205; H01Q 3/24; H01Q 1/38; H01Q 1/50; H01Q 19/10; H01Q 21/293

See application file for complete search history.

(56) References Cited

U.S. PATENT DOCUMENTS

| | | | | |
|---|---|---|---|---|
| 7,639,106 | B2 | 12/2009 | Shtrom | |
| 7,696,946 | B2 * | 4/2010 | Shtrom | H03H 7/383 343/700 MS |
| 9,570,799 | B2 | 2/2017 | Shtrom et al. | |
| 9,774,081 | B2 * | 9/2017 | Su | H01Q 3/24 |
| 9,799,963 | B2 * | 10/2017 | Huang | H01Q 21/26 |
| 10,186,785 | B2 | 1/2019 | You et al. | |
| 2006/0038738 | A1 | 2/2006 | Shtrom | |
| 2011/0248791 | A1 * | 10/2011 | Dupuy | H01P 1/15 333/101 |
| 2015/0349418 | A1 * | 12/2015 | Patron | H01Q 9/44 343/836 |
| 2017/0271748 | A1 | 9/2017 | Ku et al. | |

FOREIGN PATENT DOCUMENTS

| | | | |
|---|---|---|---|
| CN | 101473488 | A | 7/2009 |
| CN | 103700942 | A | 4/2014 |
| EP | 0022656 | B1 | 5/1985 |
| TW | 201705614 | A | 2/2017 |
| TW | I591894 | B | 7/2017 |

* cited by examiner

*Primary Examiner* — Daniel D Chang
(74) *Attorney, Agent, or Firm* — McClure, Qualey & Rodack, LLP

(57) ABSTRACT

An antenna device includes antenna units, transmission lines and switching circuits. The antenna units are used to be operated in a directional mode or an omni-directional mode. The transmission lines are coupled to the antenna units. The switching circuits are coupled to the respective transmission lines, and are used for selectively connecting the transmission lines according to control signals. At least one transmission line is disconnected when the antenna units are operated in the directional mode. All the transmission lines are connected when the antenna units are operated in the omni-directional mode.

17 Claims, 13 Drawing Sheets

ANTENNA DEVICE

CROSS-REFERENCE TO RELATED APPLICATION

This application claims priority to Taiwan Application Serial Number 107104374, filed Feb. 7, 2018, which are herein incorporated by reference.

BACKGROUND

Technology Field

The present disclosure relates to an antenna device. More particularly, the present disclosure relates to an antenna device relating to beam switching.

Description of Related Art

With the rapid development of wireless communication technology, the transmission stability of wireless signals and the energy intensity of wireless transmission are becoming more and more important in communication quality. Nowadays, a common method for solving poor communication quality is to use an antenna device with a directional antenna to align the orientation of the antenna with the direction of the user.

In recent years, the method of using a directional antenna to generate a radiation pattern is generally to couple a switch to a reflection unit, for controlling the reflection unit to adjust the radiation pattern generated by the antenna unit. However, the method of coupling the switch to the reflection unit causes the poor directivity and poor front-to-back ratio of the radiation pattern, so that the radiation pattern still receives energy in the outward direction, and interferes with other antenna devices.

Therefore, designing an antenna device that is better in directivity and front-to-back ratio without causing an impedance problem when switching between the omnidirectional mode and the directional mode becomes an important goal today.

SUMMARY

To solve the problems discussed above, the present disclosure provides an antenna device comprising antenna units, transmission lines and switching circuits. The antenna units are used for operating in a directional mode or an omni-directional mode. The transmission lines are coupled to the antenna units. The switching circuits are coupled to the respective transmission lines and are used for selectively connecting the transmission lines according to control signals to transmit a RF signal to the antenna units corresponding to the connected transmission lines. The switching circuits disconnects at least one of the transmission lines according to the control signals when the antenna units are operated in the directional mode; the switching circuits connects the transmission lines according to the control signals when the antenna units are operated in the omni-directional mode.

One embodiment of the present disclosure provides an antenna device comprising antenna units, transmission lines and impedance units. The antenna units are operated in a directional mode or an omni-directional mode. The switches are coupled to the antenna units and are used for selectively connecting the antenna units according to control signals from a control circuit to transmit a RF signal from the signal feed point to the connected antenna units. Impedance units are coupled to the respective antenna units and are coupled to the switches in series or in parallel to block the mutual interference among the control signals and the RF signal. The switches disconnect at least one of the antenna units according to the control signals when the antenna units are operated in the directional mode; the switches connect the antenna units according to the control signals when the antenna units are operated in the omni-directional mode.

In sum, the present disclosure provides switches disposed on the transmission lines and the antenna units to achieve better front-to-back ratio by changing radiation patterns via switches.

These and other features, aspects, and advantages of the present invention will become better understood with reference to the following description and appended claims.

It is to be understood that both the foregoing general description and the following detailed description are by examples, and are intended to provide further explanation of the invention as claimed.

BRIEF DESCRIPTION OF THE DRAWINGS

The invention can be more fully understood by reading the following detailed description of the embodiment, with reference made to the accompanying drawings as follows.

DETAILED DESCRIPTION

Figure 1:
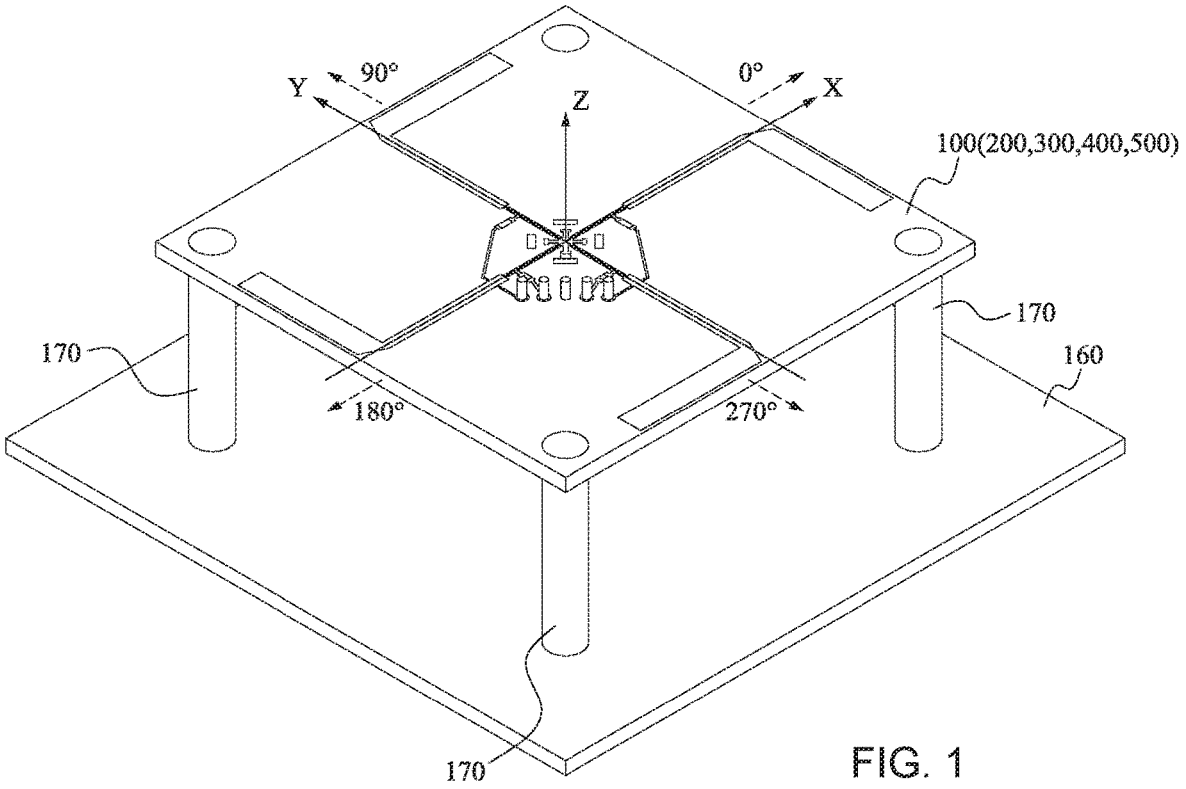
FIG. 1 is a perspective view showing an antenna device according to embodiments of the present disclosure.

Reference will now be made in detail to the present embodiments of the invention, examples of which are illustrated in the accompanying drawings. Wherever possible, the same reference numbers are used in the drawings and the description to refer to the same or like parts.

Reference will now be made in detail to the present embodiments of the invention, examples of which are illustrated in the accompanying drawings. Wherever possible, the same reference numbers are used in the drawings and the description to refer to the same or like parts.

The terms "coupled" or "connected" as used in the various embodiments below may mean that two or more elements are "directly" in physical or electrical contact, or are "indirectly" in physical or electrical contact with each other. It can also mean that two or more elements interact with each other.

In some embodiments, an antenna device 100 disclosed in the present disclosure is an antenna device 100 with adjustable radiation pattern, which can adjust the radiation pattern generated by the antenna device 100 according to the location of the user, thereby achieving better transmission efficiency.

FIG. 1 is a perspective view showing an antenna device 100 according to embodiments of the present disclosure. As shown in FIG. 1, in some embodiments, the antenna device 100 is disposed above the ground plane 160 and is connected to the ground plane 160 by four pillars 170. In some embodiments, the antenna device 100 is a horizontally polarized antenna device for generating radiation in the horizontal direction.

In some embodiments, the antenna device 100 can be integrated in an electronic device with wireless communication functions, like an Access Point (AP), a Personal Computer (PC) or a Laptop. Not limited to the above, any electronic device capable of supporting multi-input multi-output (MIMO) communication technology and having communication functions is within the scope of the present disclosure. In practical applications, the antenna device 100 adjusts its radiation pattern according to the control signal to achieve an omni-directional radiation pattern or a directional radiation pattern.

Figure 2A:
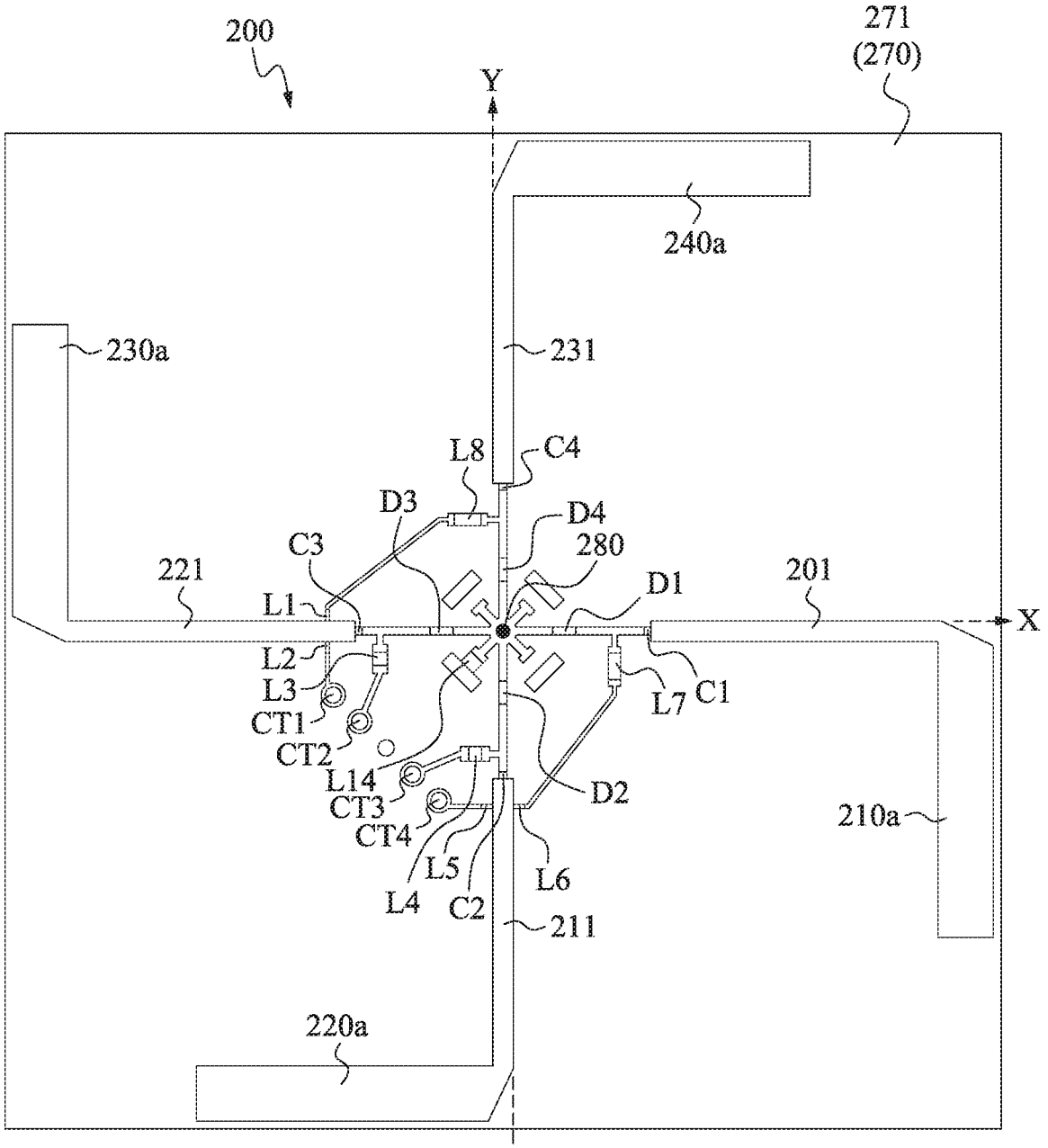
FIG. 2A is a top view showing an antenna device according to embodiments of the present disclosure.
Figure 2B:
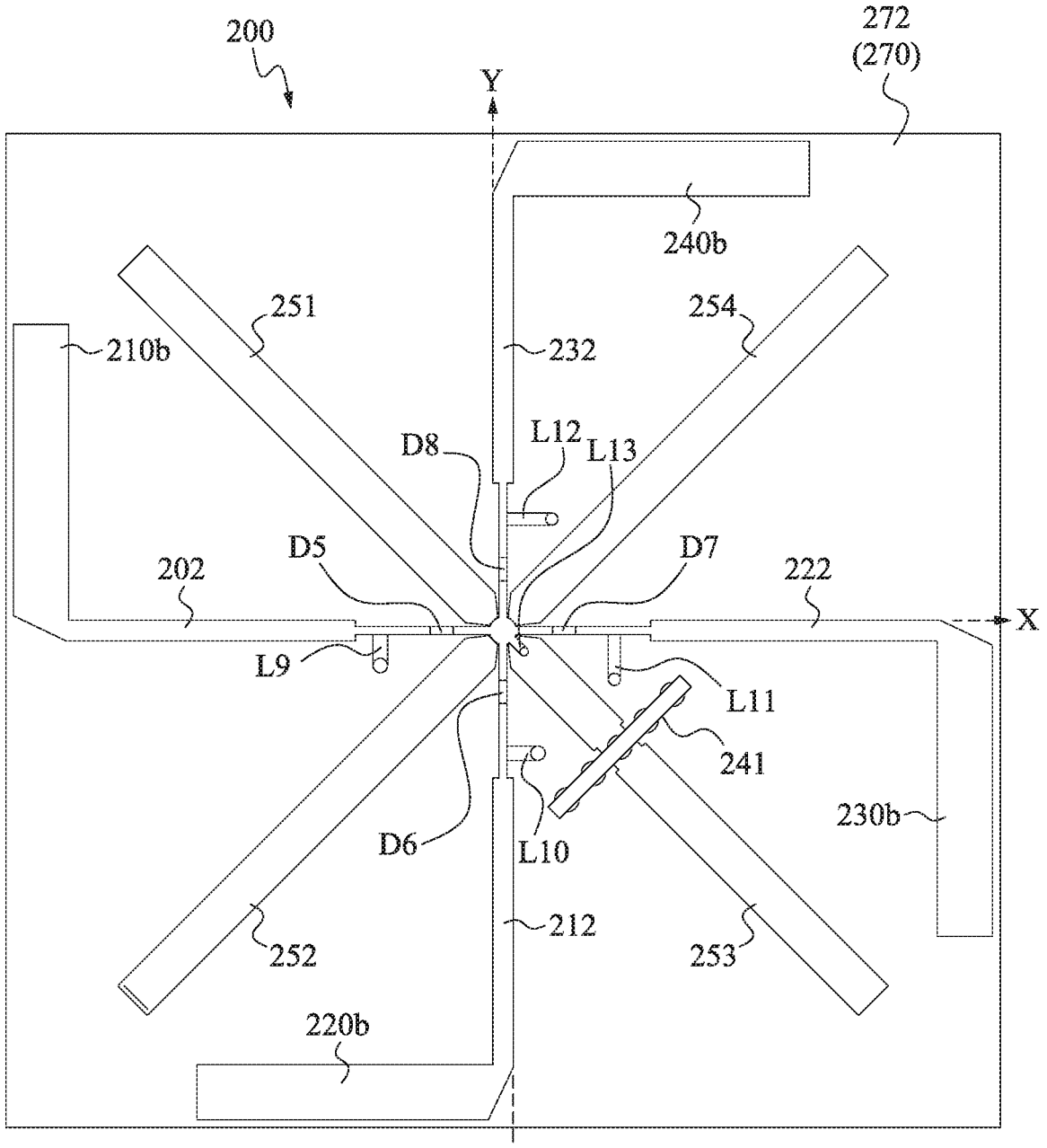
FIG. 2B is a bottom view showing an antenna device according to embodiments of the present disclosure.
Figure 2C:
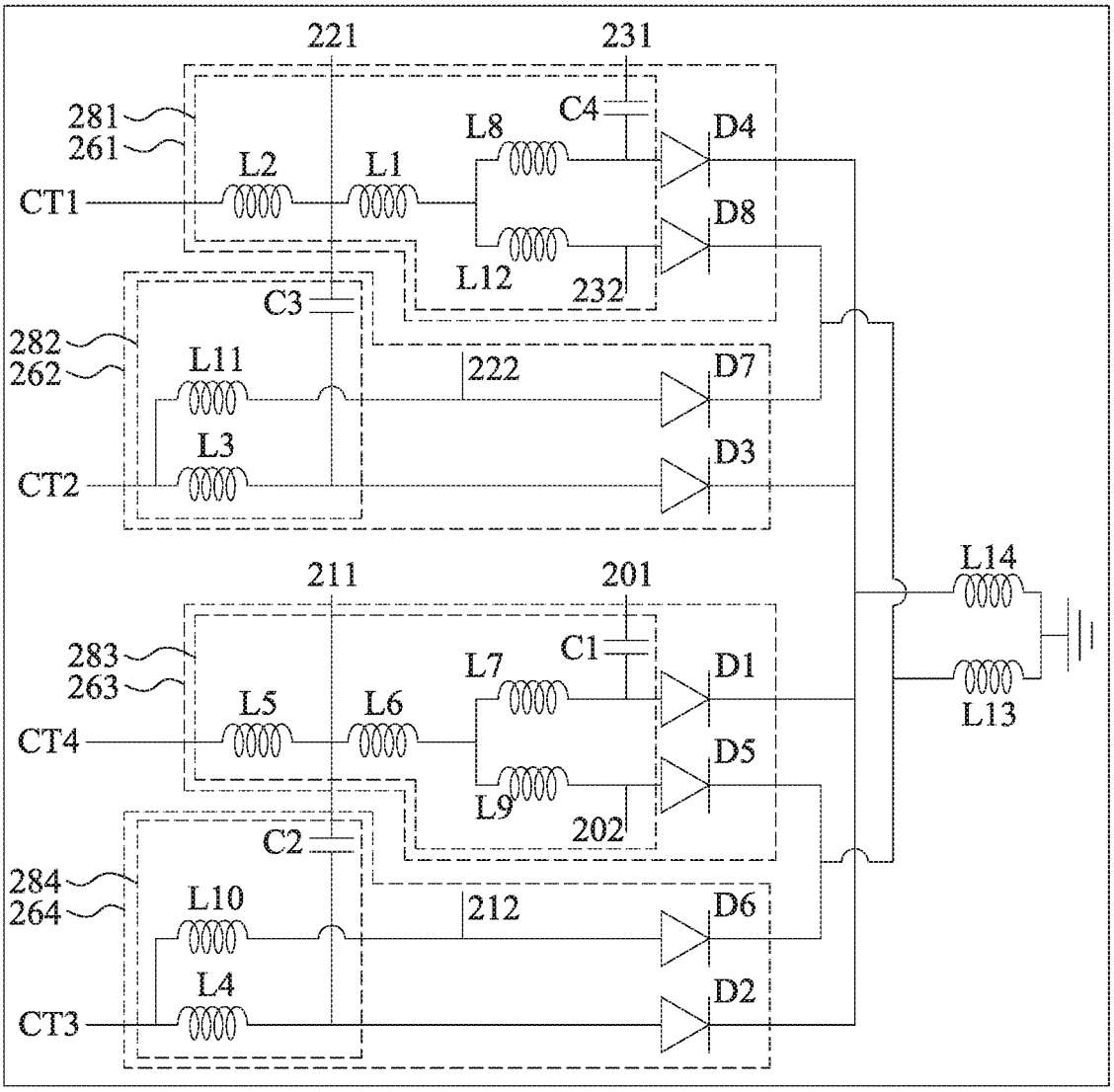
FIG. 2C is a circuit diagram of antenna devices of FIGS. 2A and 2B according to embodiments of the present disclosure.

In some embodiments, references are made to FIGS. 2A, 2B and 2C. FIG. 2A is a top view showing an antenna device 200 according to embodiments of the present disclosure. FIG. 2B is a bottom view showing an antenna device 200 according to embodiments of the present disclosure. FIG. 2C is a circuit diagram of antenna devices 200 of FIGS. 2A and 2B according to embodiments of the present disclosure. In some embodiments, the antenna device 200 is configured for operating in low frequency. For example, the low frequency includes 2.4 GHz. Not limited to the above, any frequency in which the antenna device 200 is configured for operating is within the scope of the present disclosure.

In some embodiments, as shown in FIGS. 2A, 2B and 2C, the antenna device 200 comprises antenna units 210*a*, 210*b*, 220*a*, 220*b*, 230*a*, 230*b*, 240*a* and 240*b*, reflection units 251, 252, 253 and 254, transmission lines 201, 202, 211, 212, 221, 222, 231 and 232, switching circuits 261, 262, 263 and 264, inductors L13 and L14, control circuit 241, signal feed point 280, and substrate 270. The transmission line 201 is coupled to the antenna unit 210*a*. The transmission line 202 is coupled to the antenna unit 210*b*. The transmission line 211 is coupled to the antenna unit 220*a*. The transmission line 212 is coupled to the antenna unit 220*b*. The transmission line 221 is coupled to the antenna unit 230*a*. The transmission line 222 is coupled to the antenna unit 230*b*. The transmission line 231 is coupled to the antenna unit 240*a*. The transmission line 232 is coupled to the antenna unit 240*b*. The switching circuits 261 and 262 are coupled to the transmission lines 221, 222, 231 and 232. The switching circuits 263 and 264 are coupled to the transmission lines 201, 202, 211 and 212. The switching circuits 261, 262, 263 and 264 are coupled to the inductors L13 and L14, respectively. In some embodiments, the antenna units 210*a*, 220*a*, 230*a* and 240*a* and the transmission lines 201, 211, 221 and 231 are disposed on the first surface 271 of the substrate 270. The antenna units 210*b*, 220*b*, 230*b* and 240*b*, the reflection units 251, 252, 253 and 254 and the transmission lines 202, 212, 222 and 232 are disposed on the second surface 272 of the substrate 270 opposite to the first surface 271. The antenna units 210*a* and 210*b* are disposed between the reflection units 251 and 252. The antenna units 220*a* and 220*b* are disposed between the reflection units 252 and 253. The antenna units 230*a* and 230*b* are disposed between the reflection units 253 and 254. The antenna units 240*a* and 240*b* are disposed between the reflection units 254 and 251.

In some embodiments, the signal feed point 280 is disposed at the cross points of the transmission lines 201, 202, 211, 212, 221, 222, 231 and 232. Not limited to the above, the signal feed point 280 can be disposed at any location on (or any location outside) the substrate 270 that can be connected to the antenna units 210*a*, 210*b*, 220*a*, 220*b*, 230*a*, 230*b*, 240*a* and 240*b*.

In some embodiments, the antenna units 210*a*, 210*b*, 220*a*, 220*b*, 230*a*, 230*b*, 240*a* and 240*b* are operated as transmission antennas individually receiving RF signals from the signal feed point 280, and thereby the antenna device 200 generates a radiation pattern accordingly. The direction of the radiation pattern extends outward from the signal feed point 280. In some embodiments, the antenna units 210*a*, 210*b*, 220*a*, 220*b*, 230*a*, 230*b*, 240*a* and 240*b* are operated as reception antennas individually receiving a wireless signal from users, and thereby a wireless signal channel is established accordingly. In some embodiments, the antenna units 210*a*, 210*b*, 220*a*, 220*b*, 230*a*, 230*b*, 240*a* and 240*b* can be implemented by a Planar Inverted F Antenna (PIFA), a dipole antenna or a loop antenna. Not limited to the above, any circuit element that is suitable for implementing the horizontally polarized antenna unit is within the scope of the present disclosure.

In some embodiments, the antenna device 200 has four antenna unit sets 210, 220, 230 and 240. The antenna unit set 210 includes the antenna units 210*a* and 210*b*. The antenna unit set 220 includes the antenna units 220*a* and 220*b*. The antenna unit set 230 includes the antenna units 230*a* and 230*b*. The antenna unit set 240 includes the antenna units 240*a* and 240*b*. In these embodiments, the antenna device 200 has four antenna unit sets 210, 220, 230 and 240. Not limited to the above, any antenna device 200 having more than two antenna unit sets is within the scope of the present disclosure.

In some embodiments, each of the antenna units 210*a*, 210*b*, 220*a*, 220*b*, 230*a*, 230*b*, 240*a* and 240*b* forms an L-shape with a corresponding one of the transmission lines 201, 202, 211, 212, 221, 222, 231 and 232. For example, the antenna unit 210*a* forms an L-shape with the transmission line 201. The antenna unit 210*b* forms an L-shape with the transmission line 202. The antenna unit 220*a* forms an L-shape with the transmission line 211. The antenna unit 220*b* forms an L-shape with the transmission line 212. The antenna unit 230*a* forms an L-shape with the transmission line 221. The antenna unit 230*b* forms an L-shape with the transmission line 222. The antenna unit 240*a* forms an L-shape with the transmission line 231. The antenna unit 240*b* forms an L-shape with the transmission line 232.

In some embodiments, the reflection units 251, 252, 253 and 254 are used for adjusting the radiation patterns of the antenna unit sets 210, 220, 230 and 240. For example, the reflection units 251 and 252 are used for adjusting the corresponding radiation patterns of the antenna units 210*a* and 210*b*. The reflection units 252 and 253 are used for adjusting the corresponding radiation pattern of the antenna units 220*a* and 220*b*. The reflection units 253 and 254 are used for adjusting the corresponding radiation patterns of the antenna units 230*a* and 230*b*; and the reflection units 254 and 251 are used for adjusting the corresponding radiation patterns of the antenna units 240*a* and 240*b*, and thus each of the antenna units 210*a*, 210*b*, 220*a*, 220*b*, 230*a*, 230*b*, 240*a* and 240*b* may have a directional radiation pattern. In some other embodiments, the shapes of the reflection units 251, 252, 253 and 254 can be adjusted according to the X, Y, Z axes.

In some embodiments, the reflection units 251, 252, 253 and 254 are coupled to the substrate 270 and are disposed at the two sides of each of the antenna unit sets 210, 220, 230 and 240. In some embodiments, the reflection units 251, 252, 253 and 254 can be implemented by thin metal strips. Not limited to the above, any reflection unit that can be used to implement the radiation pattern adjustment is within the scope of the present disclosure.

In some embodiments, the transmission lines 201, 202, 211, 212, 221, 222, 231 and 232 are used to transmit the RF signals from the signal feed point 280 to the antenna units 210*a*, 210*b*, 220*a*, 220*b*, 230*a*, 230*b*, 240*a* and 240*b*. In some embodiments, the transmission lines 201, 202, 211, 212, 221, 222, 231 and 232 can be implemented by metal wires. Not limited to the above, any wire that can be used to transmit RF signals is within the scope of the present disclosure.

In some embodiments, the control circuit 241 is used for generating control signals CT11, CT12, CT13 and CT14. In some embodiments, the control circuit 241 can be implemented by a server, a circuit, a central processor unit (CPU) or a microcontroller unit (MCU) having functions of computing, reading data, receiving signals or messages, transmitting signals or messages or the likes, or other electronic chips having equivalent functions.

In some embodiments, the switching circuits 261, 262, 263 and 264 are used for selectively connecting at least one of the transmission lines 201, 202, 211, 212, 221, 222, 231 and 232 according to the control signals CT11, CT12, CT13 and CT14 from the control circuit 241, to transmit RF signals to the corresponding antenna units of the antenna units 210*a*, 210*b*, 220*a*, 220*b*, 230*a*, 230*b*, 240*a* and 240*b*. In some embodiments, the practical configurations of the switching circuits 261, 262, 263 and 264 are shown in FIG. 2C.

In some embodiments, as shown in FIG. 2C, the switching circuit 261 includes a PIN diode D4, a PIN diode D8 and an impedance unit 281. The switching circuit 262 includes a PIN diode D7, a PIN diode D3 and an impedance unit 282. The switching circuit 263 includes a PIN diode D1, a PIN diode D5 and an impedance unit 283; and the switching circuit 264 includes a PIN diode D6, a PIN diode D2 and an impedance unit 284.

In some embodiments, the PIN diodes D1, D2, D3, D4, D5, D6, D7 and D8 in the switching circuits 261, 262, 263 and 264 are disposed on the transmission lines 201, 202, 211, 212, 221, 222, 231 and 232, respectively, for blocking or conducting the RF signal from the signal feed point 280 to the antenna units 210*a*, 210*b*, 220*a*, 220*b*, 230*a*, 230*b*, 240*a* and 240*b*. For example, when it is intended to disconnect the antenna units 240*a* and 240*b*, the PIN diode D4 and the PIN diode D8 are used to block the RF signal transmitting to the antenna units 240*a* and 240*b* via the transmission lines 231 and 232. When it is intended to disconnect the antenna units 230*a* and 230*b*, the PIN diode D7 and the PIN diode D3 are used to block the RF signal transmitting to the antenna units 230*a* and 230*b* via the transmission lines 221 and 222. When it is intended to disconnect the antenna units 210*a* and 210*b*, the PIN diode D1 and the PIN diode D5 are used to block the RF signal transmitting to the antenna units 210*a* and 210*b* via the transmission lines 201 and 202. When it is intended to disconnect the antenna units 220*a* and 220*b*, the PIN diode D6 and the PIN diode D2 are used to block the RF signal transmitting to the antenna units 220*a* and 220*b* via the transmission lines 211 and 212.

In some embodiments, the impedance unit 281 includes the inductors L1, L2, L8 and L12 and the capacitor C4. The impedance unit 282 includes the inductors L11 and L3 and the capacitor C3. The impedance unit 283 includes the inductors L5, L6, L7 and L9 and the capacitor C1. The impedance unit 284 includes the inductors L10 and L4 and the capacitor C2.

In some embodiments, the inductors L1-L12 in the impedance units 281, 282, 283 and 284 and the inductors L13 and L14 work as RF chokes. In particular, the inductors L1-L14 are used to block the mutual interference among the RF signals transmitting on the transmission lines 201, 202, 211, 212, 221, 222, 231 and 232. In some embodiments, the capacitors C1-C4 in the impedance units 281, 282, 283 and 284 work as DC blocks. In particular, the capacitors C1-C4 are used to block the mutual interference among the control signals CT11, CT12, CT13 and CT14.

In some embodiments, as shown in FIG. 2A, the PIN diodes D1-D4, the inductors L1-L8 and L14 and the capacitors C1-C4 are disposed on the first surface 271 of the substrate 270. In some embodiments, as shown in FIG. 2B, the PIN diodes D5-D8, the inductors L9-L13 are disposed on the second surface 272 of the substrate 270.

In some embodiments, as shown in FIG. 2C, the first end of the inductor L2 is used to receive the control signal CT11. The second end of the inductor L2 is coupled to the first end of the capacitor C3, the transmission line 221 and the first end of the inductor L1. The second end of the inductor L1 is coupled to the first end of the inductor L8 and the first end of the inductor L12. The second end of the inductor L8 is coupled to the second end of the capacitor C4 and the first end of the PIN diode D4. The first end of the capacitor C4 is coupled to the transmission line 231. The second end of the capacitor C4 is coupled to the first end of the PIN diode D4. The second end of the PIN diode D4 is coupled to the first end of the inductor L14. The second end of the inductor L12 is coupled to the transmission line 232 and the first end of the PIN diode D8. The second end of the PIN diode D8 is coupled to the first end of the inductor L13. The first end of the inductor L11 is used to receive the control signal CT12. The second end of the inductor L11 is coupled to the transmission line 222 and the first end of the PIN diode D7. The second end of the PIN diode D7 is coupled to the first end of the inductor L13. The first end of the inductor L3 is used to receive the control signal CT12. The second end of the inductor L3 is coupled to the first end of the PIN diode D3 and the second end of the capacitor C3. The second end of the PIN diode D3 is coupled to the first end of the inductor L14. The first end of the inductor L5 is used to receive the control signal CT14. The second end of the inductor L5 is coupled to the first end of the capacitor C2, the transmission line 211 and the first end of the inductor L6. The second end of the inductor L6 is coupled to the first end of the inductor L7 and the first end of the inductor L9. The second end of the inductor L7 is coupled to the second end of the capacitor C1 and the first end of the PIN diode D1. The first end of the capacitor C1 is coupled to the transmission line 201. The second end of the capacitor C1 is coupled to the first end of the PIN diode D1. The second end of the PIN diode D1 is coupled to the first end of the inductor L14. The second end of the inductor L9 is coupled to the transmission line 202 and the first end of the PIN diode D5. The second end of the PIN diode D5 is coupled to the first end of the inductor L13. The first end of the inductor L10 is used to receive the control signal CT13. The second end of the inductor L10 is coupled to the transmission line 212 and the first end of the PIN diode D6. The second end of the PIN diode D6 is coupled to the first end of the inductor L13. The first end of the inductor L4 is used to receive the control signal CT13. The second end of the inductor L4 is coupled to the first end of the PIN diode D2 and the second end of the capacitor C2. The second end of the PIN diode D2 is coupled to the first end of the inductor L14. The second end of the inductor L13 and the second end of the inductor L14 are connected to ground.

In some embodiments, the antenna device 200 has two operation modes, an omni-directional mode and a directional mode. In practical applications, the omnidirectional mode or the directivity mode is switched by controlling at least one of the PIN diodes D1, D2, D3, D4, D5, D6, D7 and D8 in the antenna device 200 to be turned on. For example, when it is intended to operate in the antenna device 200 in the omni-directional mode, all of the PIN diodes D1, D2, D3, D4, D5, D6, D7 and D8 are turned on to produce an omni-directional radiation pattern. When it is intended to operate the antenna device 200 in the directional mode, the PIN diodes D1, D4, D5 and D8 are turned on and the PIN diodes D2, D3, D6 and D7 are turned off to produce a radiation pattern as the one propagating toward the upper right of FIG. 2A; that is, the 45 degree direction as shown in FIG. 1. The PIN diodes D3, D4, D7 and D8 are turned on and the PIN diodes D1, D2, D5 and D6 are turned off to produce a radiation pattern as the one propagating toward the lower right of FIG. 2A; that is, the 135 degree direction as shown in FIG. 1. The PIN diodes D2, D3, D6 and D7 are turned on and the PIN diodes D1, D4, D5 and D8 are turned off to produce a radiation pattern as the one propagating toward the lower left of FIG. 2A; that is, the 225 degree direction as shown in FIG. 1. The PIN diodes D1, D2, D5 and D6 are turned on and the PIN diodes D3, D4, D7 and D8 are turned off to produce a radiation pattern as the one propagating toward the upper left of FIG. 2A; that is, the 315 degree direction as shown in FIG. 1.

From the embodiments mentioned above, it can be seen that when the radiation patterns of the antenna device 200 are switched, the PIN diodes on at least two adjacent transmission lines of transmission lines 201, 211, 221 and 231 are turned on. It is because that the return loss would be too large if only the PIN diodes on one of the transmission lines 201, 211, 221 and 231 are turned on.

Figure 3A:
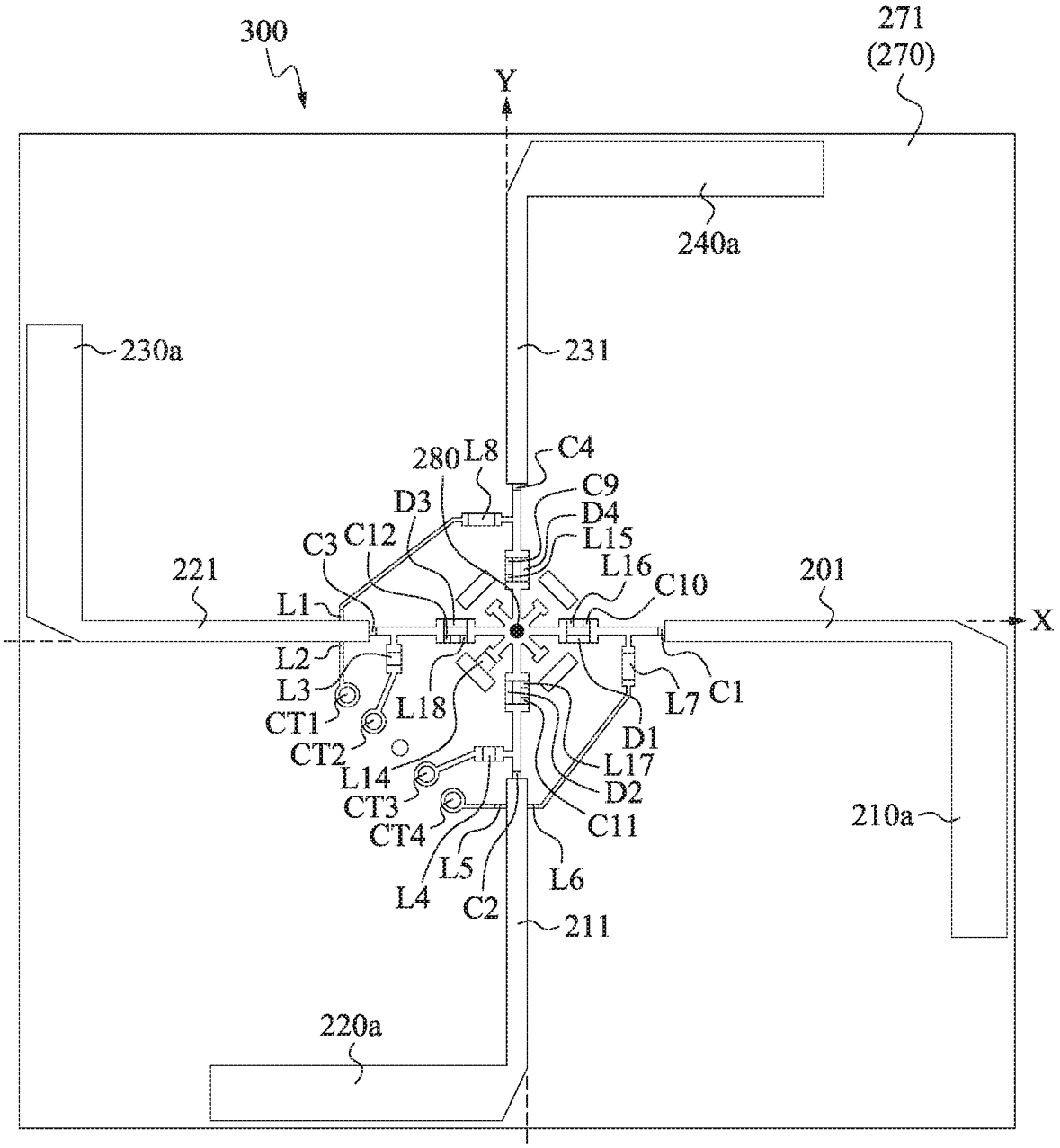
FIG. 3A is a top view showing an antenna device according to embodiments of the present disclosure.
Figure 3B:
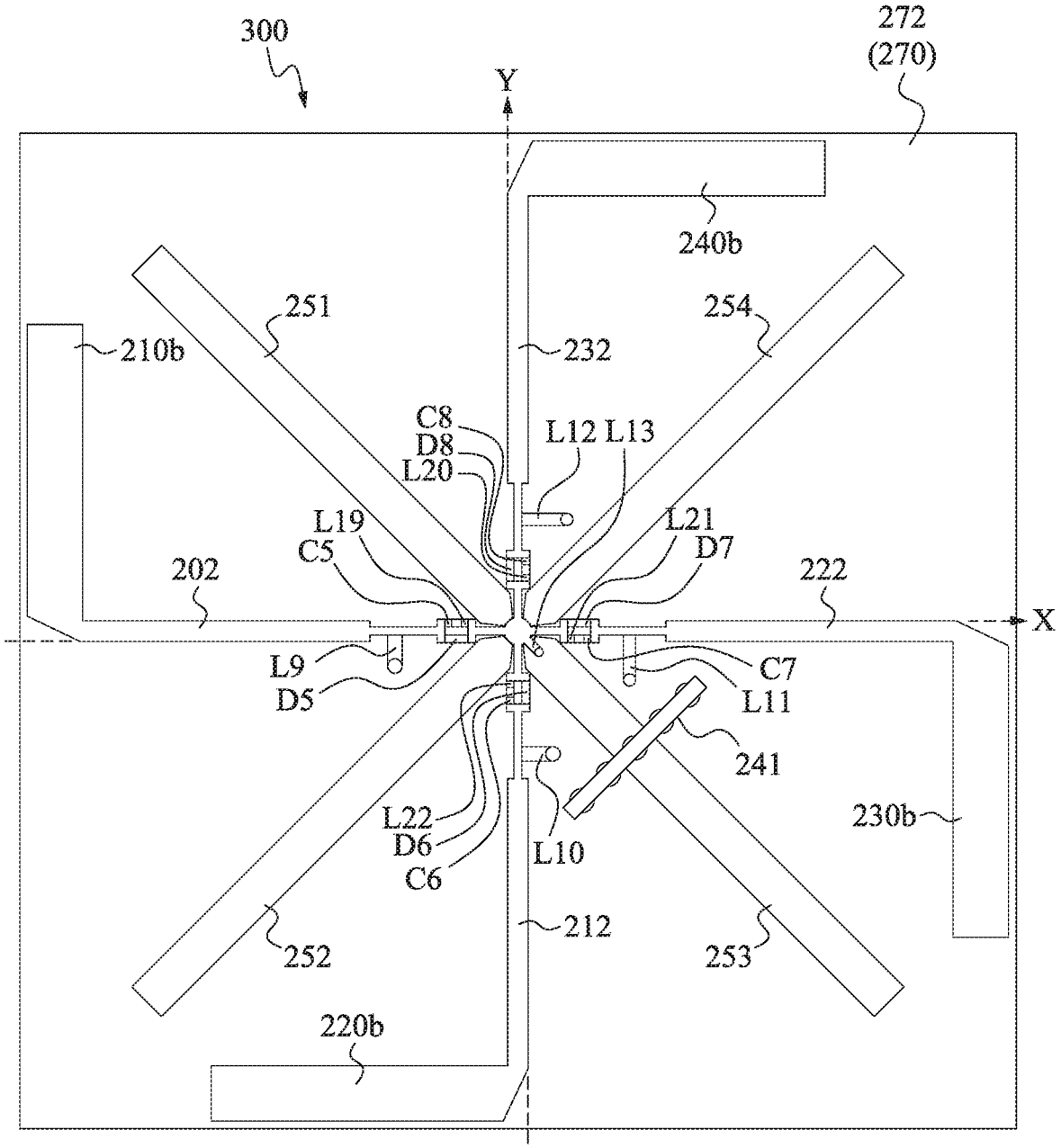
FIG. 3B is a bottom view showing an antenna device according to embodiments of the present disclosure.
Figure 3C:
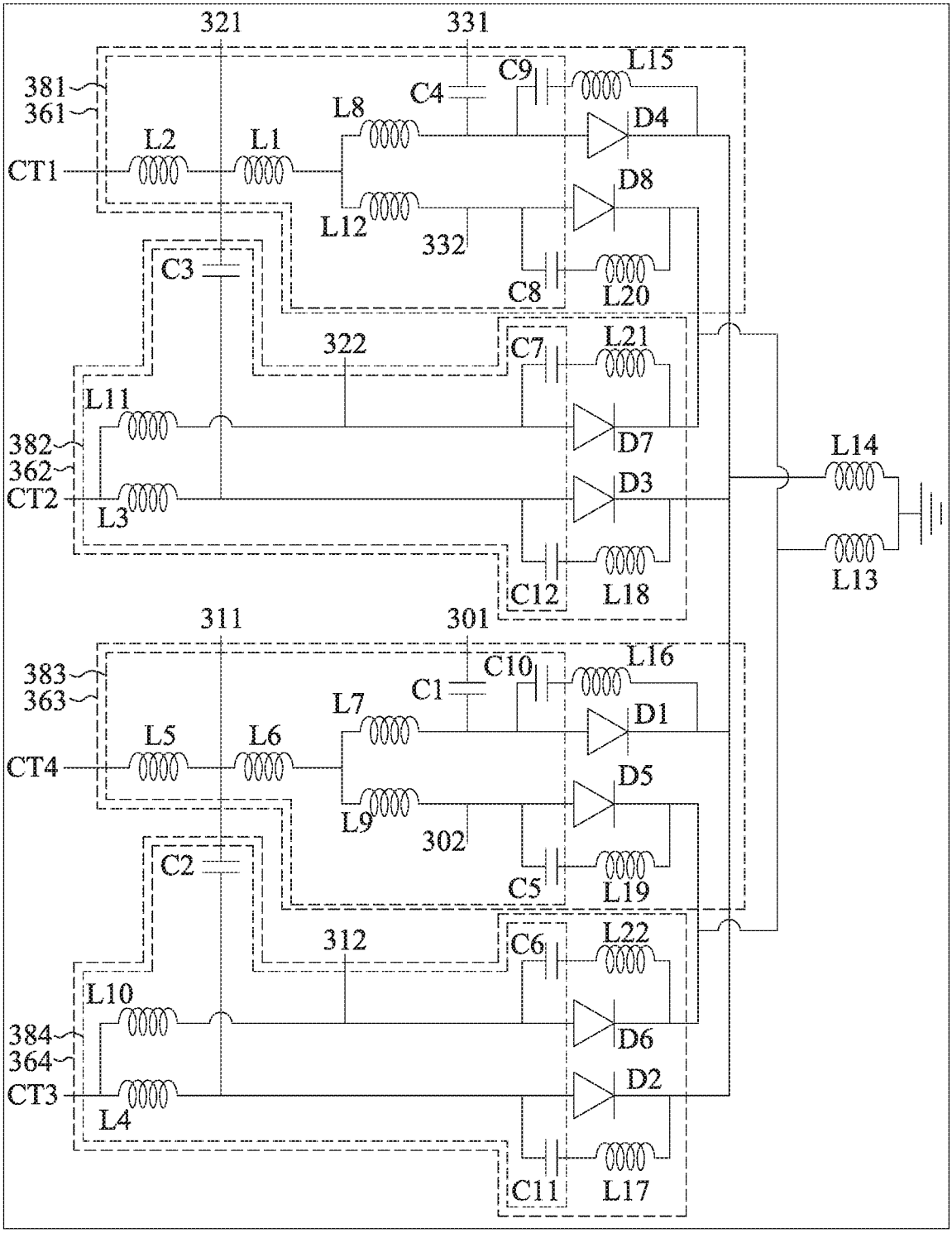
FIG. 3C is a circuit diagram of antenna devices of FIGS. 3A and 3B according to embodiments of the present disclosure.

In some embodiments, references are made to FIGS. 3A, 3B and 3C. FIG. 3A is a top view showing an antenna device 300 according to embodiments of the present disclosure. FIG. 3B is a bottom view showing an antenna device 300 according to embodiments of the present disclosure. FIG. 3C is a circuit diagram of antenna devices 300 of FIGS. 3A and 3B according to embodiments of the present disclosure. In some embodiments, the antenna device 300 is configured to operate in high frequency. For example, the high frequency includes 5 GHz. Not limited to the above, any frequency at which the antenna device 300 is configured to operate is within the scope of the present disclosure.

In some embodiments, as shown in FIGS. 3A, 3B and 3C, in addition to the antenna units 210*a*, 210*b*, 220*a*, 220*b*, 230*a*, 230*b*, 240*a* and 240*b*, the reflection units 251, 252, 253 and 254, the transmission lines 201, 202, 211, 212, 221, 222, 231 and 232, the inductors L13 and L14, the control circuit 241 and the substrate 270, the antenna device 300 further includes switching circuits 361, 362, 363 and 364. The element characteristics and the operations of the antenna units 210*a*, 210*b*, 220*a*, 220*b*, 230*a*, 230*b*, 240*a* and 240*b*, the reflection units 251, 252, 253 and 254, the transmission lines 201, 202, 211, 212, 221, 222, 231 and 232, the inductors L13 and L14, the control circuit 241 and the substrate 270 are the same as the elements with identical reference numerals in the antenna device 200.

In some embodiments, as shown in FIG. 3C, the switching circuit 361 includes the PIN diode D4, the PIN diode D8, the impedance unit 381, the inductor L15 and the inductor L20. In some embodiments, the inductor L15 and the inductor L20 are connected in parallel with the PIN diode D4 and the PIN diode D8, respectively, to form a band-stop filter blocking the RF signal. In some embodiments, as shown in FIG. 3C, the switching circuit 362 includes the PIN diode D7, the PIN diode D3, the impedance unit 382, the inductor L21 and the inductor L18. In some embodiments, the inductor L21 and the inductor L18 are connected in parallel with the PIN diode D7 and the PIN diode D3, respectively, to form a band-stop filter blocking the RF signal. In some embodiments, as shown in FIG. 3C, the switching circuit 363 includes the PIN diode D1, the PIN diode D5, the impedance unit 383, the inductor L16 and the inductor L19. In some embodiments, the inductor L16 and the inductor L19 are connected in parallel with the PIN diode D1 and the PIN diode D5, respectively, to form a band-stop blocking the RF signal. In some embodiments, as shown in FIG. 3C, the switching circuit 364 includes the PIN diode D6, the PIN diode D2, the impedance unit 384, the inductor L22 and the inductor L17. In some embodiments, the inductor L22 and the inductor L17 are connected in parallel with the PIN diode D6 and the PIN diode D2, respectively, to form a band-stop filter blocking the RF signal.

In some embodiments, the PIN diodes D1, D2, D3, D4, D5, D6, D7 and D8 in the switching circuits 361, 362, 363 and 364 are disposed on the transmission lines 201, 202, 211, 212, 221, 222, 231 and 232, respectively, for blocking or conducting the RF signal from the signal feed point 280 to the antenna units 210*a*, 210*b*, 220*a*, 220*b*, 230*a*, 230*b*, 240*a* and 240*b*. For example, when it is intended to disconnect the antenna units 240*a* and 240*b*, the PIN diode D4 and the PIN diode D8 are used to block the RF signal transmitting to the antenna units 240*a* and 240*b* via the transmission lines 231 and 232. When it is intended to disconnect the antenna units 230*a* and 230*b*, the PIN diode D7 and the PIN diode D3 are used to block the RF signal transmitting to the antenna units 230*a* and 230*b* via the transmission lines 221 and 222. When it is intended to disconnect the antenna units 210*a* and 210*b*, the PIN diode D1 and the PIN diode D5 are used to block the RF signal transmitting to the antenna units 210*a* and 210*b* via the transmission lines 201 and 202. When it is intended to disconnect the antenna units 220*a* and 220*b*, the PIN diode D6 and the PIN diode D2 are used to block the RF signal transmitting to the antenna units 220*a* and 220*b* via the transmission lines 211 and 212.

In some embodiments, as shown in FIG. 3C, the impedance unit 381 includes the inductors L2, L1, L8 and L12 and the capacitors C4, C9 and C8. The impedance unit 382 includes the inductors L11 and L3 and the capacitors C3, C7 and C12. The impedance unit 383 includes the inductors L5, L6, L7 and L9 and the capacitors C1, C10 and C5. The impedance unit 384 includes the inductors L10 and L4 and the capacitors C2, C6 and C11.

In some embodiments, the inductors L1-L12 in the impedance units 381, 382, 383 and 384 and the inductors L13 and L14 work as RF chokes. In particular, the inductors L1-L14 are used to block the mutual interference among the RF signals transmitting on the transmission lines 201, 202, 211, 212, 221, 222, 231 and 232. In some embodiments, the capacitors C1-C12 in the impedance units 381, 382, 383 and 384 work as DC blocks. In particular, the capacitors C1-C12 are used to block mutual interference among the control signals CT21, CT22, CT23 and CT24 from the control circuit 241.

In some embodiments, as shown in FIG. 3A, the PIN diodes D1-D4, the inductors L1-L8 and L1-L17 and the capacitors C1-C4 and C9-C12 are disposed on the first surface 271 of the substrate 270. In some embodiments, as shown in FIG. 3B, the PIN diodes D5-D8, the inductors L9-L13 and L19-L22 and the capacitors C5-C8 are disposed on the second surface 272 of the substrate 270. In some embodiments, as shown in FIG. 3C, the first end of the inductor L2 is used to receive the control signal CT21. The second end of the inductor L2 is coupled to the first end of the capacitor C3, the transmission line 221 and the first end of the inductor L1. The second end of the inductor L1 is coupled to the first end of the inductor L8 and the first end of the inductor L12. The second end of the inductor L8 is coupled to the second end of the capacitor C4, the first end of the PIN diode D4 and the first end of the capacitor C9. The first end of the capacitor C4 is coupled to the transmission line 231. The second end of the capacitor C4 is coupled to the first end of the capacitor C9 and the first end of the PIN diode D4. The second end of the capacitor C9 is coupled to the first end of the inductor L15. The second end of the inductor L15 is coupled to the second end of the PIN diode D4 and the first end of the inductor L14. The second end of the inductor L12 is coupled to the transmission line 232, the first end of the PIN diode D8 and the first end of the capacitor C8. The second end of the capacitor C8 is coupled to the first end of the inductor L20. The second end of the inductor L20 is coupled to the second end of the PIN diode D8 and the first end of the inductor L13. The first end of the inductor L11 is used to receive the control signal CT22. The second end of the inductor L11 is coupled to the transmission line 222, the first end of the PIN diode D7 and the first end of the capacitor C7. The second end of the capacitor C7 is coupled to the first end of the inductor L21. The second end of the inductor L21 is coupled to the second end of the PIN diode D7 and the first end of the inductor L13. The first end of the inductor L3 is used to receive the control signal CT22. The second end of the inductor L3 is coupled to the first end of the PIN diode D3, the second end of the capacitor C3 and the first end of the capacitor C12. The second end of the capacitor C12 is coupled to the first end of the inductor L18. The second end of the inductor L18 is coupled to the second end of the PIN diode D3 and the first end of the inductor L14. The first end of the inductor L5 is used to receive the control signal CT24. The second end of the inductor L5 is coupled to the first end of the capacitor C2, the transmission line 211 and the first end of the inductor L6. The second end of the inductor L6 is coupled to the first end of the inductor L7 and the first end of the inductor L9. The second end of the inductor L7 is coupled to the second end of the capacitor C1, the first end of the PIN diode D1 and the first end of the capacitor C10. The first end of the capacitor C1 is coupled to the transmission line 201. The second end of the capacitor C1 is coupled to the first end of the PIN diode D1 and the first end of the capacitor C10. The second end of the capacitor C10 is coupled to the first end of the inductor L16. The second end of the inductor L16 is coupled to the second end of the PIN diode D1 and the first end of the inductor L14. The second end of the inductor L9 is coupled to the transmission line 202, the first end of the PIN diode D5 and the first end of the capacitor C5. The second end of the capacitor C5 is coupled to the first end of the inductor L19. The second end of the inductor L19 is coupled to the second end of the PIN diode D5 and the first end of the inductor L13. The first end of the inductor L10 is used to receive the control signal CT23. The second end of the inductor L10 is coupled to the transmission line 212, the first end of the PIN diode D6 and the first end of the capacitor C6. The second end of the capacitor C6 is coupled to the first end of the inductor L22. The second end of the inductor L22 is coupled to the second end of the PIN diode D6 and the first end of the inductor L13. The first end of the inductor L4 is used to receive the control signal CT23. The second end of the inductor L4 is coupled to the first end of the PIN diode D2, the second end of the capacitor C2 and the first end of the capacitor C11. The second end of the capacitor C11 is coupled to the first end of the inductor L17. The second end of the inductor L17 is coupled to the second end of the PIN diode D2 and the first end of the inductor L14. The second end of the inductor L13 and the second end of the inductor L14 are connected to ground.

In some embodiments, the antenna device 300 has two operation modes, an omni-directional mode and a directional mode. In practical applications, the omnidirectional mode or the directivity mode is switched by turning on at least one of the PIN diodes D1, D2, D3, D4, D5, D6, D7 and D8 in the antenna device 300. For example, when it is intended to operate the antenna device 300 in the omni-directional mode, all of the PIN diodes D1, D2, D3, D4, D5, D6, D7 and D8 are turned on to produce the omni-directional radiation pattern. When it is intended to operate the antenna device 300 in the directional mode, the PIN diodes D1, D4, D5 and D8 are turned on and the PIN diodes D2, D3, D6 and D7 are turned off to produce a radiation pattern as the one propagating toward the upper right of FIG. 3A; that is, the 45 degree direction as shown in FIG. 1. The PIN diodes D3, D4, D7 and D8 are turned on and the PIN diodes D1, D2, D5 and D6 are turned off to produce a radiation pattern as the one propagating toward the lower right of FIG. 3A; that is, the 135 degree direction as shown in FIG. 1. The PIN diodes D2, D3, D6 and D7 are turned on and the PIN diodes D1, D4, D5 and D8 are turned off to produce a radiation pattern as the one propagating toward the lower left of FIG. 3A; that is, the 225 degree direction as shown in FIG. 1. The PIN diodes D1, D2, D5 and D6 are turned on and the PIN diodes D3, D4, D7 and D8 are turned off to produce a radiation pattern as the one propagating toward the upper left of FIG. 3A; that is, the 315 degree direction as shown in FIG. 1.

Figure 4A:
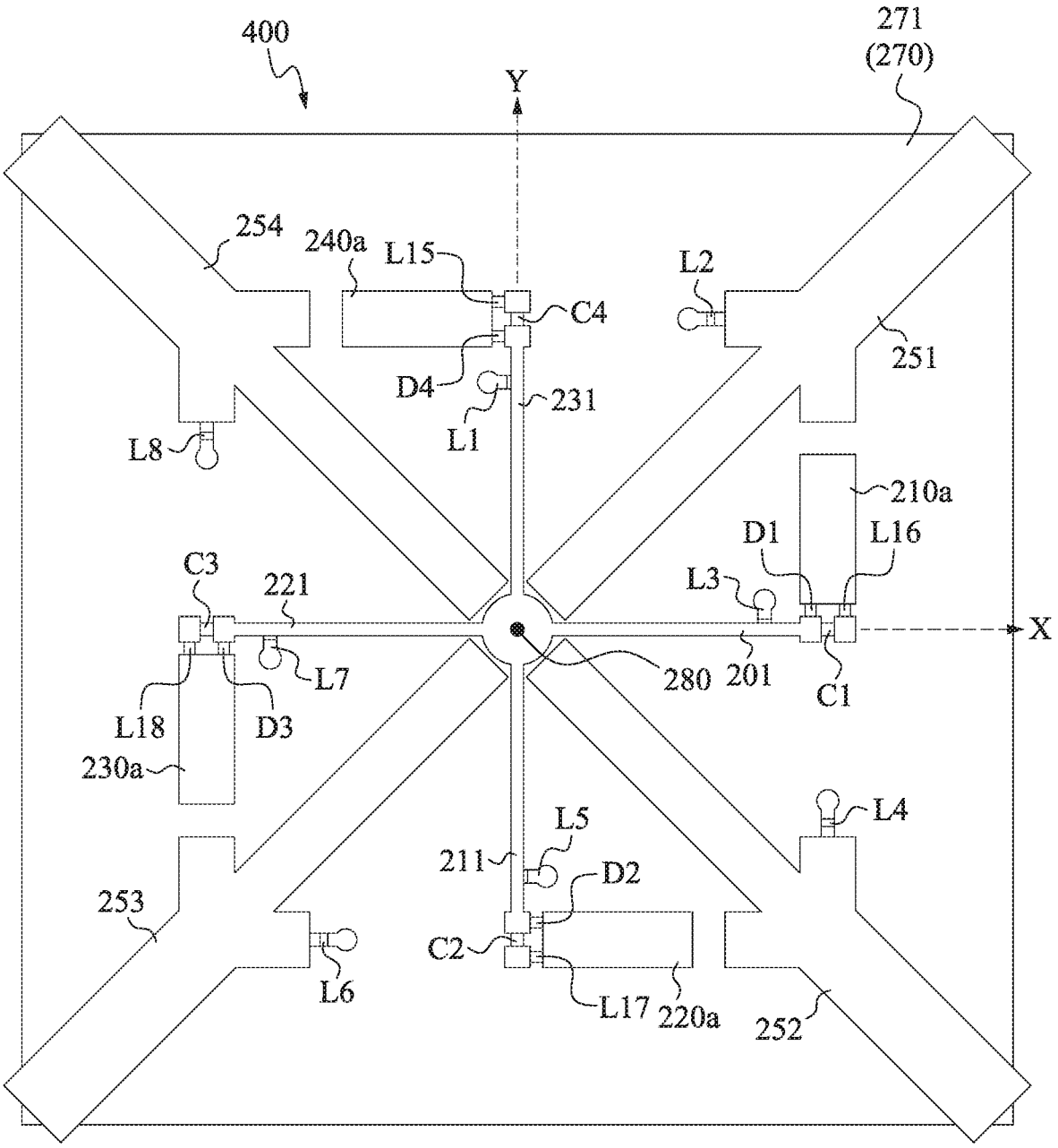
FIG. 4A is a top view showing an antenna device according to embodiments of the present disclosure.
Figure 4B:
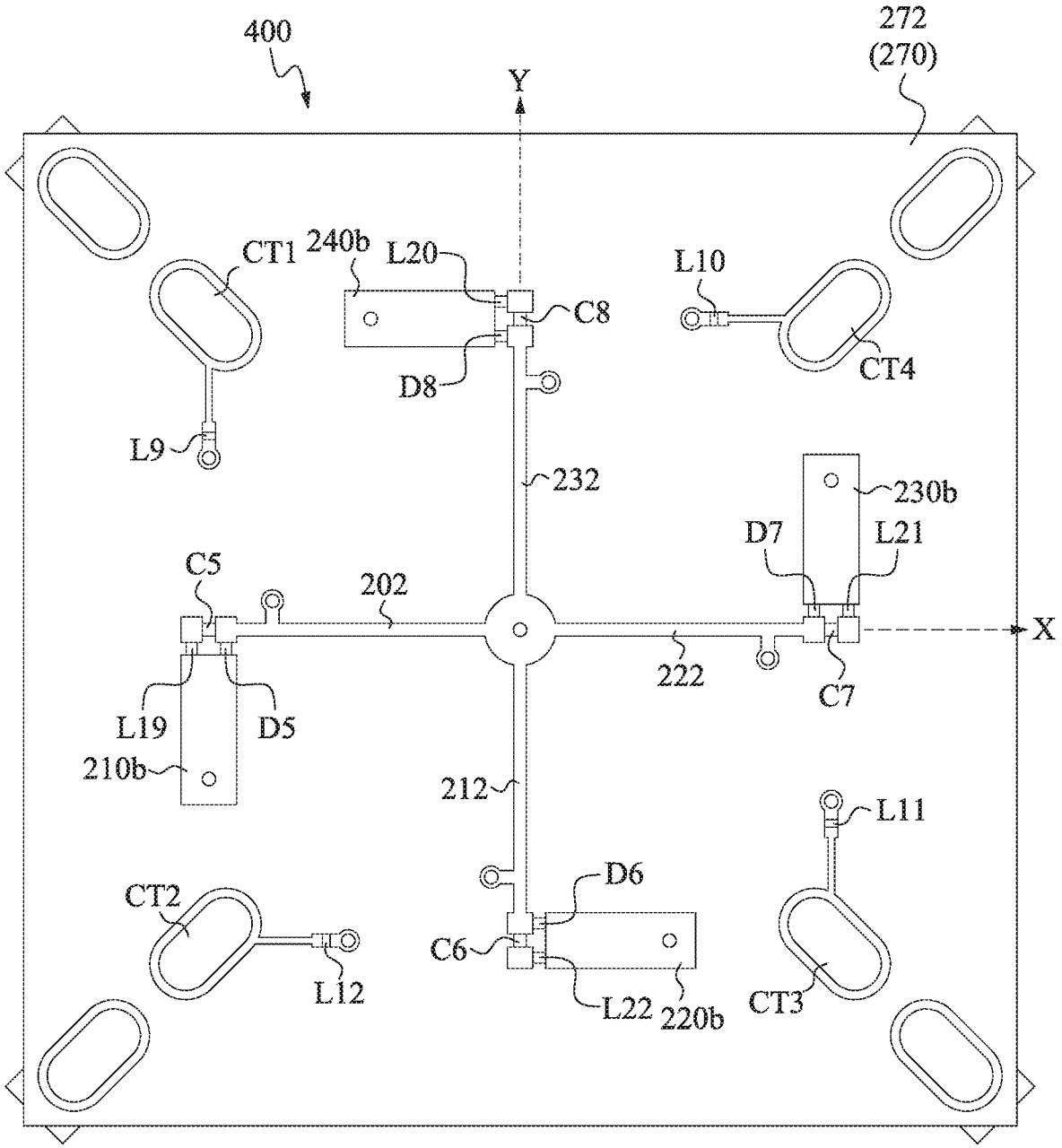
FIG. 4B is a bottom view showing an antenna device according to embodiments of the present disclosure.
Figure 4C:
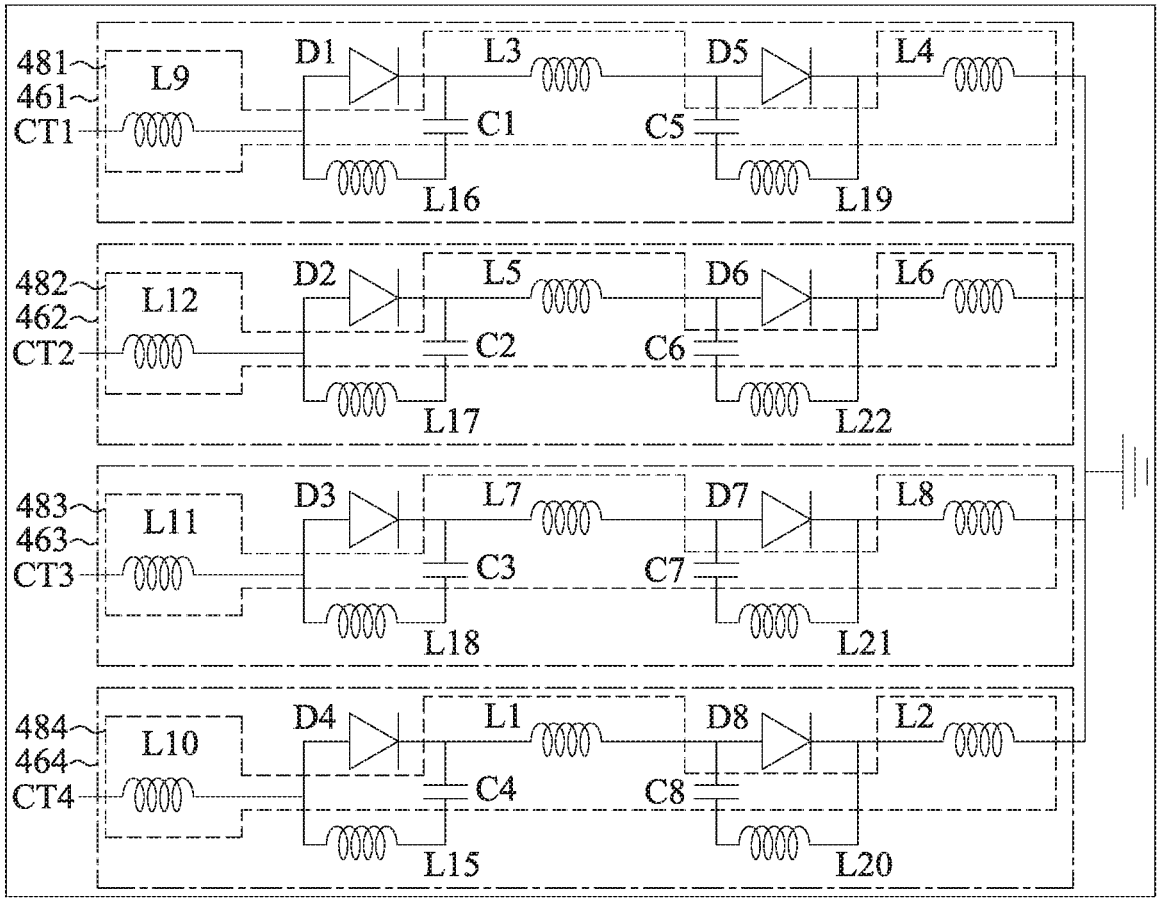
FIG. 4C is a circuit diagram of antenna devices of FIGS. 4A and 4B according to embodiments of the present disclosure.

In some embodiments, references are made to FIGS. 4A, 4B and 4C. FIG. 4A is a top view showing an antenna device 400 according to embodiments of the present disclosure. FIG. 4B is a bottom view showing an antenna device 400 according to embodiments of the present disclosure. FIG. 4C is a circuit diagram of antenna devices 400 of FIGS. 4A and 4B according to embodiments of the present disclosure. In some embodiments, the antenna device 400 is configured to operate in high frequency. For example, the high frequency includes 5 GHz. Not limited to the above, any frequency in which the antenna device 400 could be configured to operate is within the scope of the present disclosure.

In some embodiments, as shown in FIGS. 4A and 4B, in addition to the antenna units 210*a*, 210*b*, 220*a*, 220*b*, 230*a*, 230*b*, 240*a* and 240*b*, the reflection units 251, 252, 253 and 254, the transmission lines 201, 202, 211, 212, 221, 222, 231 and 232, the control circuit (not shown) and the substrate 270, the antenna device 400 further includes switching circuits 461, 462, 463 and 464. The element characteristics and the operations of the antenna units 210*a*, 210*b*, 220*a*, 220*b*, 230*a*, 230*b*, 240*a* and 240*b*, the reflection units 251, 252, 253 and 254, the transmission lines 201, 202, 211, 212, 221, 222, 231 and 232, the control circuit (not shown) and the substrate 270 are the same as the elements with identical reference numerals in the antenna device 200.

In some embodiments, as shown in FIG. 4C, the switching circuit 461 includes the PIN diode D1, the PIN diode D5, the impedance unit 481, the inductor L16 and the inductor L19. In some embodiments, the inductor L16 and the inductor L19 are connected in parallel with the PIN diode D4 and the PIN diode D5, respectively, to form a band-stop filter blocking the RF signal. In some embodiments, as shown in FIG. 4C, the switching circuit 462 includes the PIN diode D2, the PIN diode D6, the impedance unit 482, the inductor L17 and the inductor L22. In some embodiments, the inductor L17 and the inductor L22 are connected in parallel with the PIN diode D2 and the PIN diode D6, respectively, to form a band-stop filter blocking the RF signals. In some embodiments, as shown in FIG. 4C, the switching circuit 463 includes the PIN diode D3, the PIN diode D7, the impedance unit 483, the inductor L18 and the inductor L21. In some embodiments, the inductor L18 and the inductor L21 are connected in parallel with the PIN diode D3 and the PIN diode D7, respectively, to form a band-stop filter blocking the RF signals. In some embodiments, as shown in FIG. 4C, the switching circuit 464 includes the PIN diode D4, the PIN diode D8, the impedance unit 484, the inductor L15 and the inductor L20. In some embodiments, the inductor L15 and the inductor L20 are connected in parallel with the PIN diode D4 and the PIN diode D8, respectively, to form a band-stop filter blocking the RF signal.

In some embodiments, the PIN diodes D1, D2, D3, D4, D5, D6, D7 and D8 in the switching circuits 461, 462, 463 and 464 are disposed on the antenna units 210*a*, 210*b*, 220*a*, 220*b*, 230*a*, 230*b*, 240*a* and 240*b*, respectively, for blocking or conducting the RF signal from the signal feed point 280 to the antenna units 210*a*, 210*b*, 220*a*, 220*b*, 230*a*, 230*b*, 240*a* and 240*b*. For example, when it is intended to disconnect the antenna units 240*a* and 240*b*, the PIN diode D4 and the PIN diode D8 are used to block the RF signal transmitting to the antenna units 240*a* and 240*b*. When it is intended to disconnect the antenna units 230*a* and 230*b*, the PIN diode D7 and the PIN diode D3 are used to block the RF signal transmitting to the antenna units 230*a* and 230*b*. When it is intended to disconnect the antenna units 210*a* and 210*b*, the PIN diode D1 and the PIN diode D5 are used to block the RF signal transmitting to the antenna units 210*a* and 210*b*. When it is intended to disconnect the antenna units 220*a* and 220*b*, the PIN diode D6 and the PIN diode D2 are used to block the RF signal transmitting to the antenna units 220*a* and 220*b*.

In some embodiments, as shown in FIG. 4C, the impedance unit 481 includes the inductor L9, the capacitor C1, the inductor L3, the capacitor C5 and the inductor L4. The impedance unit 482 includes the inductor L12, the capacitor C2, the inductor L5, the capacitor C6 and the inductor L6. The impedance unit 483 includes the inductor L11, the capacitor C3, the inductor L7, the capacitor C7 and the inductor L8. The impedance unit 484 includes the inductor L10, the capacitor C4, the inductor L1, the capacitor C8 and the inductor L2.

In some embodiments, the inductors L1-L12 in the impedance units 481, 482, 483 and 484 work as RF chokes. In particular, the inductors L1-L12 are used to block the mutual interference among the RF signals transmitting on the transmission lines 210*a*, 210*b*, 220*a*, 220*b*, 230*a*, 230*b*, 240*a* and 240*b*. In some embodiments, the capacitors C1-C8 in the impedance units 481, 482, 483 and 484 work as DC blocks. In particular, the capacitors C1-C8 are used to block the mutual interference among the control signals CT31, CT32, CT33 and CT34 from the control circuit (not shown).

In some embodiments, as shown in FIG. 4A, the PIN diodes D1-D4, the inductors L1-L8 and L15-L18 and the capacitors C1-C4 are disposed on the first surface 271 of the substrate 270. In some embodiments, as shown in FIG. 4B, the PIN diodes D5-D8, the inductors L9-L13 and L19-L22 and the capacitors C5-C8 are disposed on the second surface 272 of the substrate 270.

In some embodiments, as shown in FIG. 4C, the first end of the inductor L9 is used to receive the control signal CT31. The second end of the inductor L9 is coupled to the first end of the PIN diode D1 and the first end of the inductor L16. The second end of the inductor L16 is coupled to the first end of the capacitor C1. The second end of the PIN diode D1 is coupled to the second end of the capacitor C1 and the first end of the inductor L3. The second end of the inductor L3 is coupled to the first end of the PIN diode D5 and the first end of the capacitor C5. The second end of the capacitor C5 is coupled to the first end of the inductor L19. The second end of the inductor L19 is coupled to the second end of the PIN diode D5 and the first end of the inductor L4. The second end of the inductor L4 is connected to ground. The first end of the inductor L12 is used to receive the control signal CT32. The second end of the inductor L12 is coupled to the first end of the PIN diode D2 and the first end of the inductor L17. The second end of the inductor L17 is coupled to the first end of the capacitor C2. The second end of the PIN diode D2 is coupled to the second end of the capacitor C2 and the first end of the inductor L5. The second end of the inductor L5 is coupled to the first end of the PIN diode D6 and the first end of the capacitor C6. The second end of the capacitor C6 is coupled to the first end of the inductor L22. The second end of the inductor L22 is coupled to the second end of the PIN diode D6 and the first end of the inductor L6. The second end of the inductor L6 is connected to ground. The first end of the inductor L11 is used to receive the control signal CT33. The second end of the inductor L11 is coupled to the first end of the PIN diode D3 and the first end of the inductor L18. The second end of the inductor L18 is coupled to the first end of the capacitor C3. The second end of the PIN diode D3 is coupled to the second end of the capacitor C3 and the first end of the inductor L7. The second end of the inductor L7 is coupled to the first end of the PIN diode D7 and the first end of the capacitor C7. The second end of the capacitor C7 is coupled to the first end of the inductor L21. The second end of the inductor L21 is coupled to the second end of the PIN diode D7 and the first end of the inductor L8. The second end of the inductor L8 is connected to ground. The first end of the inductor L10 is used to receive the control signal CT34. The second end of the inductor L10 is coupled to the first end of the PIN diode D4 and the first end of the inductor L15. The second end of the inductor L15 is coupled to the first end of the capacitor C4. The second end of the PIN diode D4 is coupled to the second end of the capacitor C4 and the first end of the inductor L1. The second end of the inductor L1 is coupled to the first end of the PIN diode D8 and the first end of the capacitor C8. The second end of the capacitor C8 is coupled to the first end of the inductor L20. The second end of the inductor L20 is coupled to the second end of the PIN diode D8 and the first end of the inductor L2. The second end of the inductor L2 is connected to ground.

In some embodiments, the antenna device 400 has two operation modes, an omni-directional mode and a directional mode. In practical applications, the omnidirectional mode or the directivity mode is switched by turning on at least one of the PIN diodes D1, D2, D3, D4, D5, D6, D7 and D8 in the antenna device 400. For example, when it is intended to operate the antenna device 400 in the omni-directional mode, all of the PIN diodes D1, D2, D3, D4, D5, D6, D7 and D8 are turned on to produce an omni-directional radiation pattern. The PIN diodes D1, D4, D5 and D8 are turned on and the PIN diodes D2, D3, D6 and D7 are turned off to produce a radiation pattern as the one propagating toward the upper right of FIG. 4A; that is, the 45 degree direction as shown in FIG. 1. The PIN diodes D3, D4, D7 and D8 are turned on and the PIN diodes D1, D2, D5 and D6 are turned off to produce a radiation pattern as the one propagating toward the lower right of FIG. 4A; that is, the 135 degree direction as shown in FIG. 1. The PIN diodes D2, D3, D6 and D7 are turned on and the PIN diodes D1, D4, D5 and D8 are turned off to produce a radiation pattern as the one propagating toward the lower left of FIG. 4A; that is, the 225 degree direction as shown in FIG. 1. The PIN diodes D1, D2, D5 and D6 are turned on and the PIN diodes D3, D4, D7 and D8 are turned off to produce a radiation pattern as propagating toward the upper left of FIG. 4A; that is, the 315 degree direction as shown in FIG. 1.

Figure 5A:
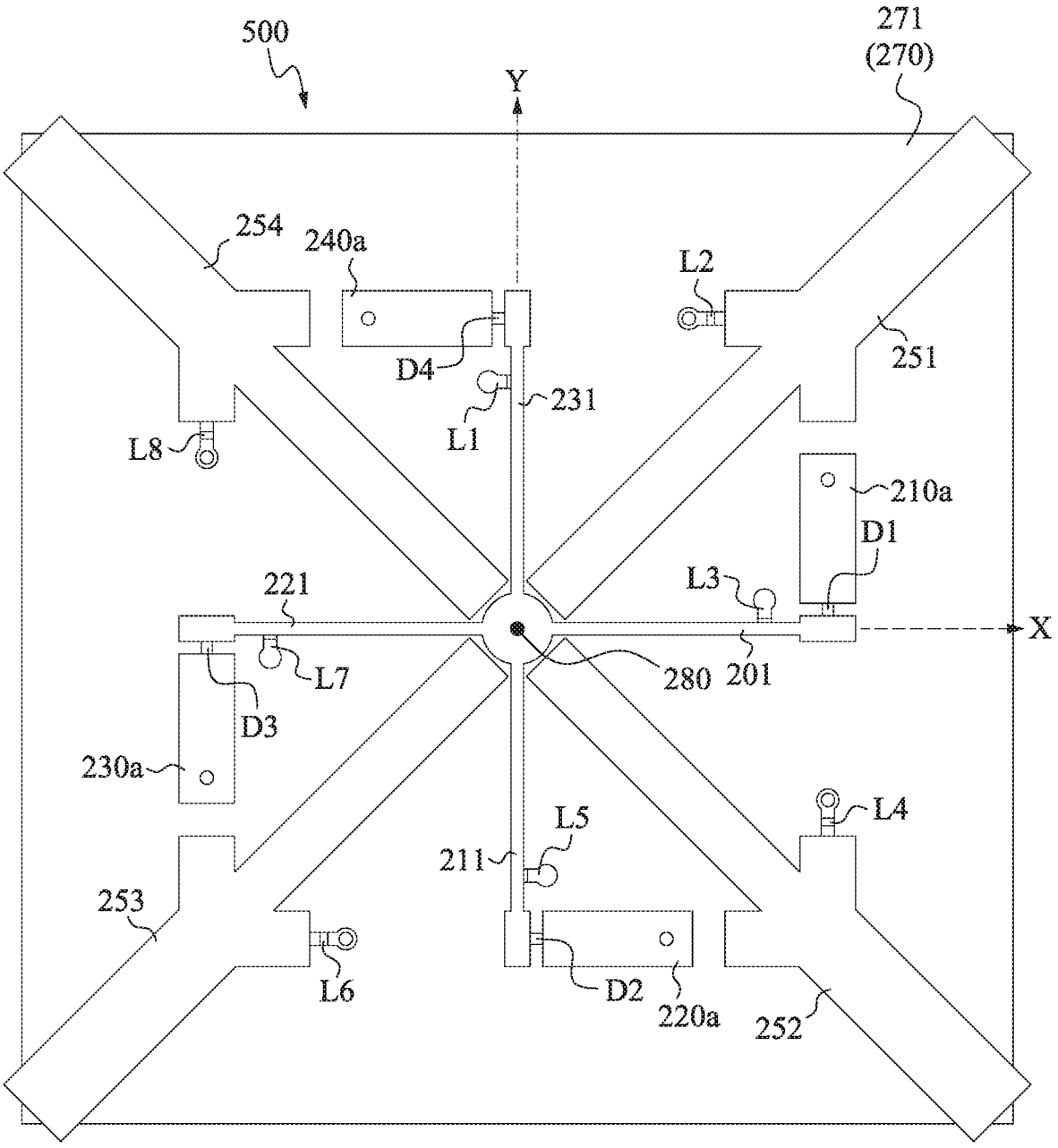
FIG. 5A is a top view showing an antenna device according to embodiments of the present disclosure.
Figure 5B:
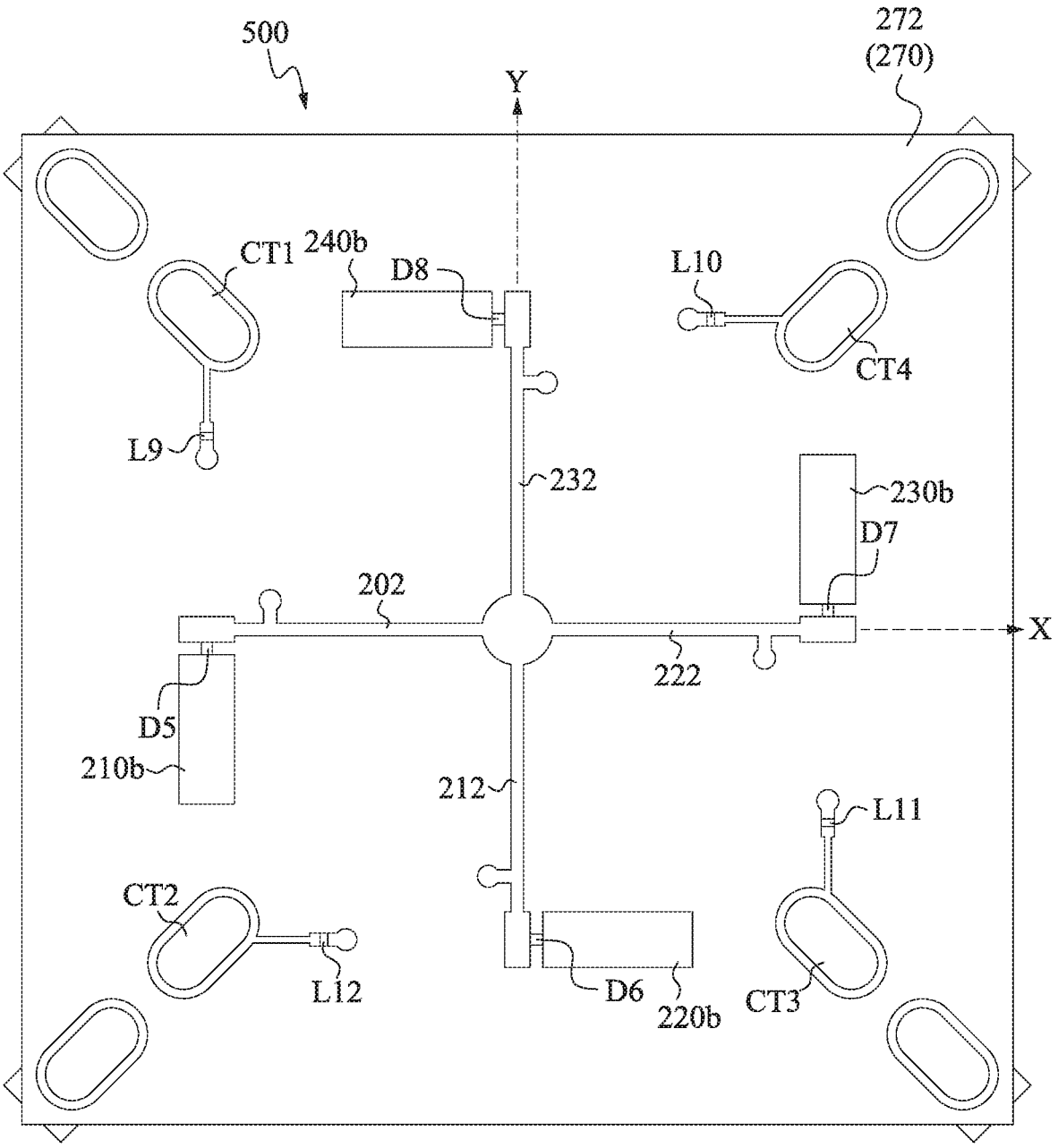
FIG. 5B is a bottom view showing an antenna device according to embodiments of the present disclosure.
Figure 5C:
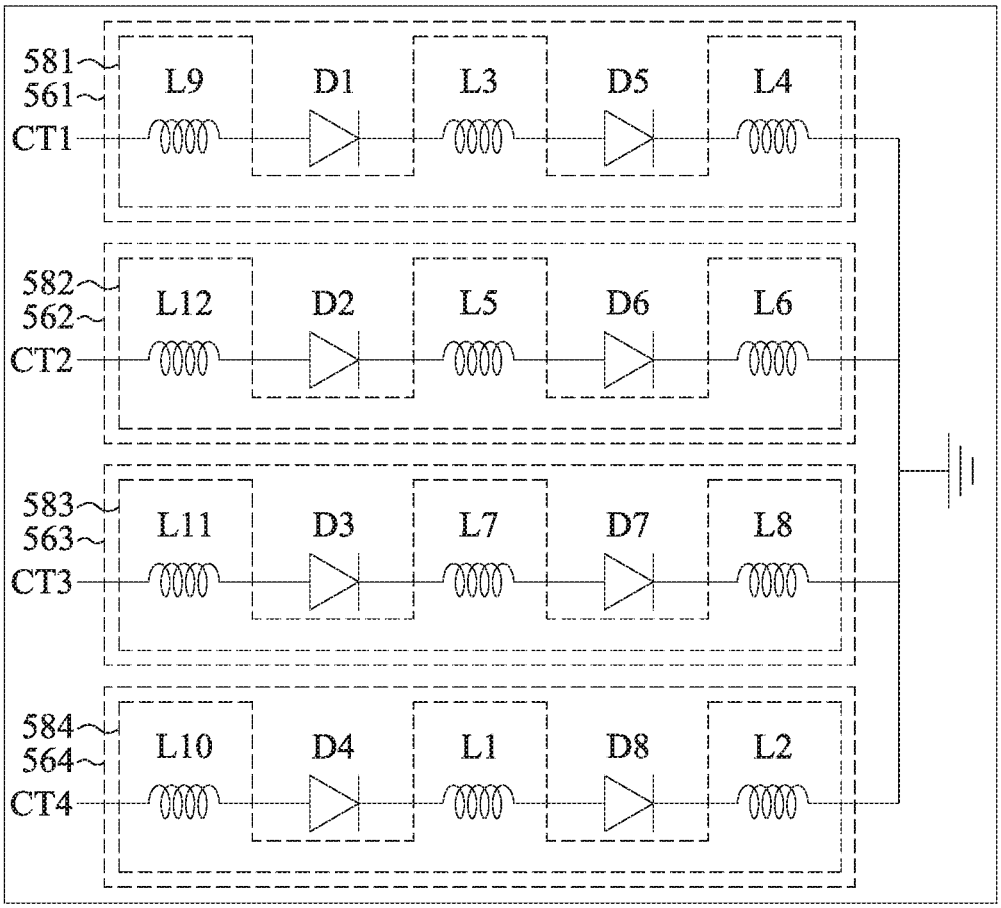
FIG. 5C is a circuit diagram of antenna devices of FIGS. 5A and 5B according to embodiments of the present disclosure.

In some embodiments, references are made to FIGS. 5A, 5B and 5C. FIG. 5A is a top view showing an antenna device 500 according to embodiments of the present disclosure. FIG. 5B is a bottom view showing an antenna device 500 according to embodiments of the present disclosure. FIG. 5C is a circuit diagram of antenna devices 500 of FIGS. 5A and 5B according to embodiments of the present disclosure. In some embodiments, the antenna device 500 is configured to operate in low frequency. For example, the low frequency includes 2.4 GHz. Not limited to the above, any frequency in which the antenna device 500 is configured to operate is within the scope of the present disclosure.

In some embodiments, as shown in FIGS. 5A and 5B, in addition to the antenna units 210*a*, 210*b*, 220*a*, 220*b*, 230*a*, 230*b*, 240*a* and 240*b*, the reflection units 251, 252, 253 and 254, the transmission lines 201, 202, 211, 212, 221, 222, 231 and 232, the control circuit (not shown) and the substrate 270, the antenna device 500 further comprises switching circuits 561, 562, 563 and 564. The element characteristics and the operations of the antenna units 210*a*, 210*b*, 220*a*, 220*b*, 230*a*, 230*b*, 240*a* and 240*b*, the reflection units 251, 252, 253 and 254, the transmission lines 201, 202, 211, 212, 221, 222, 231 and 232, the control circuit (not shown) and the substrate 270 are the same as the elements with identical reference numerals in the antenna device 200.

In some embodiments, as shown in FIG. 5C, the switching circuit 561 includes a PIN diode D1, a PIN diode D5 and an impedance unit 581. The switching circuit 562 includes a PIN diode D2, a PIN diode D6 and an impedance unit 582. The switching circuit 563 includes a PIN diode D3, a PIN diode D7 and an impedance unit 583. The switching circuit 564 includes a PIN diode D4, a PIN diode D9 and an impedance unit 584. In some embodiments, the PIN diodes D1, D2, D3, D4, D5, D6, D7 and D8 are disposed on the antenna units 210*a*, 210*b*, 220*a*, 220*b*, 230*a*, 230*b*, 240*a* and 240*b*, respectively, for selectively disconnecting or connecting at least one of the antenna units 210*a*, 210*b*, 220*a*, 220*b*, 230*a*, 230*b*, 240*a* and 240*b* according to control signals CT41, CT42, CT43 and CT44, to transmit the RF signal from the signal feed point 280 to the antenna units 210*a*, 210*b*, 220*a*, 220*b*, 230*a*, 230*b*, 240*a* and 240*b*. For example, when it is intended to disconnect the antenna units 240*a* and 240*b*, the PIN diode D4 and the PIN diode D8 are used to block the RF signal transmitting to the antenna units 240*a* and 240*b*. When it is intended to disconnect the antenna units 230*a* and 230*b*, the PIN diode D7 and the PIN diode D3 are used to block the RF signal transmitting to the antenna units 230*a* and 230*b*. When it is intended to disconnect the antenna units 210*a* and 210*b*, the PIN diode D1 and the PIN diode D5 are used to block the RF signal transmitting to the antenna units 210*a* and 210*b*. When it is intended to disconnect the antenna units 220*a* and 220*b*, the PIN diode D6 and the PIN diode D2 are used to block the RF signal transmitting to the antenna units 220*a* and 220*b*.

In some embodiments, as shown in FIG. 5C, the impedance unit 581 includes the inductor L9, the inductor L3 and the inductor L4. The impedance unit 582 includes the inductor L12, the inductor L5 and the inductor L16. The impedance unit 583 includes the inductor L11, the inductor L7 and the inductor L8. The impedance unit 584 includes the inductor L10, the inductor L1 and the inductor L2.

In some embodiments, the inductors L1-L12 in the impedance units 581, 582, 583 and 584 work as RF chokes. In particular, the inductors L1-L12 are used to block the mutual interference among the RF signals transmitting on the transmission lines 210*a*, 210*b*, 220*a*, 220*b*, 230*a*, 230*b*, 240*a* and 240*b*.

In some embodiments, a control circuit (not shown) is used to produce control signals CT41, CT42, CT43 and CT44 to control the PIN diodes D1, D2, D3, D4, D5, D6, D7 and D8 to selectively connect the antenna units 210*a*, 210*b*, 220*a*, 220*b*, 230*a*, 230*b*, 240*a* and 240*b*.

In some embodiments, as shown in FIG. 5A, the PIN diodes D1-D4, the inductors L1-L8 are disposed on the first surface 271 of the substrate 270. In some embodiments, as shown in FIG. 5B, the PIN diodes D5-D8, the inductors L9-L12 are disposed on the second surface 272 of the substrate 270.

In some embodiments, as shown in FIG. 5C, the first end of the inductor L9 is used to receive the control signal CT41. The second end of the inductor L9 is coupled to the first end of the PIN diode D1. The second end of the PIN diode D1 is coupled to the first end of the inductor L3. The second end of the inductor L3 is coupled to the first end of the PIN diode D5. The second end of the PIN diode D5 is coupled to the first end of the inductor L4. The second end of the inductor L4 is connected to ground. The first end of the inductor L12 is used to receive the control signal CT42. The second end of the inductor L12 is coupled to the first end of the PIN diode D2. The second end of the PIN diode D2 is coupled to the first end of the inductor L5. The second end of the inductor L5 is coupled to the first end of the PIN diode D6. The second end of the PIN diode D6 is coupled to the first end of the inductor L6. The second end of the inductor L6 is connected to ground. The first end of the inductor L11 is used to receive the control signal CT43. The second end of the inductor L11 is coupled to the first end of the PIN diode D3. The second end of the PIN diode D3 is coupled to the first end of the inductor L7. The second end of the inductor L7 is coupled to the first end of the PIN diode D7. The second end of the PIN diode D7 is coupled to the first end of the inductor L8. The second end of the inductor L8 is connected to ground. The first end of the inductor L10 is used to receive the control signal CT44. The second end of the inductor L10 is coupled to the first end of the PIN diode D4. The second end of the PIN diode D4 is coupled to the first end of the inductor L1. The second end of the inductor L1 is coupled to the first end of the PIN diode D8. The second end of the PIN diode D8 is coupled to the first end of the inductor L2. The second end of the inductor L2 is connected to ground.

In some embodiments, the antenna device 500 has two operation modes, an omni-directional mode and a directional mode. In practical applications, the omnidirectional mode or the directivity mode is switched by turning on at least one of the PIN diodes D1, D2, D3, D4, D5, D6, D7 and D8 in the antenna device 500. For example, all of the PIN diodes D1, D2, D3, D4, D5, D6, D7 and D8 are turned on to produce an omni-directional radiation pattern. The PIN diodes D1, D4, D5 and D8 are turned on and the PIN diodes D2, D3, D6 and D7 are turned off to produce a radiation pattern as the one propagating toward the upper right of FIG. 5A; that is, the 45 degree direction as shown in FIG. 1. The PIN diodes D3, D4, D7 and D8 are turned on and the PIN diodes D1, D2, D5 and D6 are turned off to produce a radiation pattern as the one propagating toward the lower right of FIG. 5A; that is, the 135 degree direction as shown in FIG. 1. The PIN diodes D2, D3, D6 and D7 are turned on and the PIN diodes D1, D4, D5 and D8 are turned off to produce a radiation pattern as the one propagating toward the lower left of FIG. 5A; that is, the 225 degree direction as shown in FIG. 1. The PIN diodes D1, D2, D5 and D6 are turned on and the PIN diodes D3, D4, D7 and D8 are turned off to produce a radiation pattern as the one propagating toward the upper left of FIG. 5A, that is, the 315 degree direction as shown in FIG. 1.

In practical applications, when the antenna devices 100, 200, 300, 400 and 500 detect that a user enters a particular beam footprint, the internal switches (e.g., the PIN diodes D1-D8) are all switched on to produce an omni-directional radiation pattern. Then, according to the Received Signal Strength Indicator (RSSI) received by the antenna units 210*a*, 210*b*, 220*a*, 220*b*, 230*a*, 230*b*, 240*a* and 240*b*, some of the internal switches (e.g., the PIN diodes D1-D8) are switched on to adjust the beam to orient to the user, to maximize the data rate between the antenna devices 100, 200, 300, 400 and 500 and the user.

In sum, the present disclosure achieves switching radiation patterns via the PIN diodes 210*a*, 210*b*, 220*a*, 220*b*, 230*a*, 230*b*, 240*a* and 240*b* and a better front-to-back ratio, by disposing the PIN diodes 210*a*, 210*b*, 220*a*, 220*b*, 230*a*, 230*b*, 240*a* and 240*b* on the transmission lines 201, 202, 211, 212, 221, 222, 231 and 232 in the antenna devices 200 and 300.

Although the present invention has been described in considerable detail with reference to certain embodiments thereof, other embodiments are possible. Therefore, the spirit and scope of the appended claims should not be limited to the description of the embodiments contained herein.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims.

What is claimed is:

1. An antenna device, comprising:

a plurality of antenna units for operating in a directional mode or an omni-directional mode;

a plurality of transmission lines coupled to the antenna units and a signal feed point; and a plurality of switching circuits coupled to the respective transmission lines and used for selectively connecting the transmission lines according to a plurality of control signals from a control circuit in order to transmit a RF signal from the signal feed point to the antenna units corresponding to the connected transmission lines, the switching circuits disconnect at least one of the transmission lines according to the control signals when the antenna units are operated in the directional mode; and the switching circuits connect the transmission lines according to the control signals when the antenna units are operated in the omni-directional mode, wherein each of the switching circuits comprises a plurality of PIN diodes, at least one capacitor and a plurality of inductors, wherein the at least one capacitor is coupled to the PIN diodes to block mutual interference among the control signals, and the inductors and the PIN diodes are connected in parallel to block the RF signal transmitting to at least one of the antenna units when the antenna device is operated in high frequency, which allows the antenna device to produce a directional radiation pattern for the antenna device.

2. The antenna device of claim 1, wherein the inductors and the PIN diodes are connected in series to block the RF signal transmitting to at least one of the antenna units when the antenna device is operated in low frequency, which allows the antenna device to produce a directional radiation pattern.

3. The antenna device of claim 1, wherein the switching circuits comprises a first switching circuit, the first switching circuit comprises:

a first inductor, a first end of the first inductor receiving a first control signal of the control signals, a second end of the first inductor coupled to a first transmission line of the transmission lines;

a second inductor, a first end of the second inductor coupled to a second end of the first inductor and the first transmission line;

a third inductor, a first end of the third inductor coupled to a second end of the second inductor;

a fourth inductor, a first end of the fourth inductor coupled to the second end of the second inductor and the first end of the third inductor, a second end of the fourth inductor coupled to a second transmission line of the transmission lines;

a first capacitor, a first end of the first capacitor coupled to a third transmission line of the transmission lines, a second end of the first capacitor coupled to a second end of the third inductor;

a first PIN diode, a first end of the first PIN diode coupled to the second end of the first capacitor and the second end of the third inductor; and a second PIN diode, a first end of the second PIN diode coupled to the second end of the fourth inductor and the second transmission line.

4. The antenna device of claim 3, wherein the first switching circuit of the switching circuits further comprises:

the second end of the first capacitor, the second end of the third inductor and the first end of the first PIN diode;

a fifth inductor, a first end of the fifth inductor coupled to a second end of the second capacitor, a second end of the fifth inductor coupled to a second end of the first PIN diode;

a third capacitor, a first end of the third capacitor coupled to the second end of the fourth inductor, the second transmission line and the first end of the second PIN diode; and a sixth inductor, a first end of the sixth inductor coupled to a second end of the third capacitor, a second end of the sixth inductor coupled to a second end of the second PIN diode.

5. The antenna device of claim 1, wherein the switching circuits comprises a second switching circuit, the second switching circuit comprises:

a first inductor, a first end of the first inductor receiving a second control signal of the control signals, a second end of the first inductor coupled to a first transmission line of the transmission lines;

a second inductor, a first end of the second inductor receiving the second control signal;

a first capacitor, a first end of the first capacitor coupled to a second transmission line of the transmission lines, a second end of the first capacitor coupled to a second end of the second inductor;

a first PIN diode, a first end of the first PIN diode coupled to a second end of the first inductor and the first transmission line;

a second PIN diode, a first end of the second PIN diode coupled to the second end of the first capacitor.

6. The antenna device of claim 5, wherein the second switching circuit of the switching circuits further comprises:

a second capacitor, a first end of the second capacitor coupled to a second end of the first inductor, the first transmission line and a first end of the first PIN diode;

a third inductor, a first end of the third inductor coupled to the second end of the second capacitor, a second end of the third inductor coupled to a second end of the first PIN diode;

a third capacitor, a first end of the third capacitor coupled to the second end of the second inductor, the second end of the first capacitor and the first end of the second PIN diode; and a fourth inductor, a first end of the fourth inductor coupled to a second end of the third capacitor, a second end of the fourth inductor coupled to a second end of the second PIN diode.

7. The antenna device of claim 1, wherein at least one of the switching circuits comprises:

a first inductor, a first end of the first inductor receiving a first control signal of the control signals, a second end of the first inductor coupled to a first transmission line of the transmission lines;

a second inductor, a first end of the second inductor coupled to a second end of the first inductor and the first transmission line;

a third inductor, a first end of the third inductor coupled to a second end of the second inductor;

a fourth inductor, a first end of the fourth inductor coupled to a second end of the second inductor and a first end of the third inductor, a second end of the fourth inductor coupled to a second transmission line of the transmission lines;

a first capacitor, a first end of the first capacitor coupled to a third transmission line of the transmission lines, a second end of the first capacitor coupled to a second end of the third inductor;

a first PIN diode, a first end of the first PIN diode coupled to a second end of the first capacitor and a second end of the third inductor;

a second PIN diode, a first end of the second PIN diode coupled to a second end of the fourth inductor and the second transmission line;

a fifth inductor, a first end of the fifth inductor receiving a second control signal of the control signals, a second end of the fifth inductor coupled to a fourth transmission line of the transmission lines;

a sixth inductor, a first end of the sixth inductor receiving the second control signal;

a second capacitor, a first end of the second capacitor coupled to the first transmission line, the first inductor and the second inductor, a second end of the second capacitor coupled to a second end of the sixth inductor;

a third PIN diode, a first end of the third PIN diode coupled to a second end of the fifth inductor and the fourth transmission line, a second end of the third PIN diode coupled to a second end of the second PIN diode; and a fourth PIN diode, a first end of the fourth PIN diode coupled to a second end of the sixth inductor and a second end of the second capacitor, a second end of the fourth PIN diode coupled to a second end of the first PIN diode.

8. The antenna device of claim 1, wherein at least one of the switching circuits comprises:

a first inductor, a first end of the first inductor receiving a first control signal of the control signals, a second end of the first inductor coupled to a first transmission line of the transmission lines;

a second inductor, a first end of the second inductor coupled to a second end of the first inductor and the first transmission line;

a third inductor, a first end of the third inductor coupled to a second end of the second inductor;

a fourth inductor, a first end of the fourth inductor coupled to a second end of the second inductor and a first end of the third inductor, a second end of the fourth inductor coupled to a second transmission line of the transmission lines;

a first capacitor, a first end of the first capacitor coupled to a third transmission line of the transmission lines, a second end of the first capacitor coupled to a second end of the third inductor;

a first PIN diode, a first end of the first PIN diode coupled to a second end of the first capacitor and a second end of the third inductor;

a second capacitor, a first end of the second capacitor coupled to a second end of the first capacitor, a second end of the third inductor and a first end of the first PIN diode;

a fifth inductor, a first end of the fifth inductor coupled to a second end of the second capacitor, a second end of the fifth inductor coupled to a second end of the first PIN diode;

a second PIN diode, a first end of the second PIN diode coupled to a second end of the fourth inductor and the second transmission line;

a third capacitor, a first end of the third capacitor coupled to a second end of the fourth inductor, the second transmission line and a first end of the second PIN diode;

a sixth inductor, a first end of the sixth inductor coupled to a second end of the third capacitor, a second end of the sixth inductor coupled to a second end of the second PIN diode;

a seventh inductor, a first end of the seventh inductor receiving a second control signal of the control signals, a second end of the seventh inductor coupled to a fourth transmission line of the transmission lines;

an eighth inductor, a first end of the eighth inductor receiving the second control signal;

a fourth capacitor, a first end of the fourth capacitor coupled to the first transmission line, a second end of the fourth capacitor coupled to a second end of the eighth inductor;

a third PIN diode, a first end of the third PIN diode coupled to a second end of the seventh inductor and the fourth transmission line, a second end of the third PIN diode coupled to a second end of the second PIN diode and a second end of the sixth inductor;

a fifth capacitor, a first end of the fifth capacitor coupled to a second end of the seventh inductor, the fourth transmission line and a first end of the third PIN diode;

a ninth inductor, a first end of the ninth inductor coupled to a second end of the fifth capacitor, a second end of the ninth inductor coupled to a second end of the third PIN diode, a second end of the second PIN diode and a second end of the sixth inductor;

a fourth PIN diode, a first end of the fourth PIN diode coupled to a second end of the eighth inductor and a second end of the fourth capacitor, a second end of the fourth PIN diode coupled to a second end of the first PIN diode and a second end of the fifth inductor;

a sixth capacitor, a first end of the sixth capacitor coupled to a second end of the eighth inductor, a second end of the fourth capacitor and a first end of the fourth PIN diode; and a tenth inductor, a first end of the tenth inductor coupled to a second end of the sixth capacitor, a second end of the tenth inductor coupled to a second end of the fourth PIN diode, a second end of the first PIN diode and a second end of the fifth inductor.

9. The antenna device of claim 1, wherein at least one of the antenna units, at least one of the transmission lines and at least one of the switching circuits are disposed at a first surface of a substrate, and at least one of the other antenna units, at least one of the other transmission lines and at least one of the other switching circuits are disposed at a second surface of the substrate opposite to the first surface.

10. The antenna device of claim 1, further comprising:

a plurality of reflection units coupled to a substrate, the reflection units disposed on two sides of each of the antenna units for adjusting a radiation pattern of the antenna units.

11. The antenna device of claim 1, wherein each of the antenna units is formed an L-shape with a corresponding one of the transmission lines, and the signal feed point is disposed at cross points of the transmission lines and coupled to the antenna units via the transmission lines.

12. An antenna device, comprising:

a plurality of antenna units coupled to a signal feed point for operating in a directional mode or an omni-directional mode; and a plurality of switches coupled to the respective antenna units and used for selectively connecting the antenna units according to a plurality of control signals from a control circuit, in order to transmit a RF signal from the signal feed point to the antenna units, a plurality of impedance units coupled to the respective antenna units and coupled to the respective switches in series or in parallel to block mutual interference among the control signals and the RF signal, wherein the switches disconnect at least one of the antenna units according to the control signals when the antenna units are operated in the directional mode, and the switches connect the antenna units according to the control signals when the antenna units are operated in the omni-directional mode, and when the antenna device is operated in high frequency, the antenna device further comprises a plurality of inductors and PIN diodes, wherein the inductors and the PIN diodes are connected in parallel to block the RF signal transmitting to at least one of the antenna units, which allows the antenna device to produce a directional radiation pattern.

13. The antenna device of claim 12, wherein when the antenna device is operated in low frequency, the switches block the RF signal transmitting to at least one of the antenna units, which allows the antenna device to produce a directional radiation pattern.

14. The antenna device of claim 12, wherein the switches comprise:

a first PIN diode and a second PIN diode;

at least one of the impedance units comprises:

a first inductor, a first end of the first inductor receiving one of the control signals, a second end of the first inductor coupled to a first end of the first PIN diode;

a second inductor, a first end of the second inductor coupled to a second end of the first PIN diode, a second end of the second inductor coupled to a first end of the second PIN diode; and a third inductor, a first end of the third inductor coupled to a second end of the second PIN diode, a second end of the third inductor coupled to ground.

15. The antenna device of claim 14, wherein at least one of the impedance units further comprises:

a fourth inductor, a first end of the fourth inductor coupled to a second end of the first inductor and a first end of the first PIN diode;

a first capacitor, a first end of the first capacitor coupled to a second end of the fourth inductor, a second end of the first capacitor coupled a second end of the first PIN diode and a first end of the second inductor;

a second capacitor, a first end of the second capacitor coupled to a second end of the second inductor and a first end of the second PIN diode; and a fifth inductor, a first end of the fifth inductor coupled to a second end of the second capacitor, a second end of the fifth inductor coupled to a second end of the second PIN diode and a first end of the third inductor.

16. The antenna device of claim 12, further comprising:

a plurality of reflection units coupled to a substrate, the reflection units disposed on two sides of each of the antenna units for adjusting a radiation pattern produced by the antenna units.

17. The antenna device of claim 12, further comprising: a plurality of transmission lines, wherein each of the antenna units is formed an L-shape with a corresponding one of the transmission lines, and the signal feed point is disposed at cross points of the transmission lines for coupled to the antenna units via the transmission lines.

* * * * *